US011618073B2

(12) United States Patent
Burt et al.

(10) Patent No.: US 11,618,073 B2
(45) Date of Patent: Apr. 4, 2023

(54) METHOD FOR MANUFACTURING A TRACTION ELEMENT USING A CORING PROCESS

(71) Applicant: Pride Manufacturing Company, LLC, Brentwood, TN (US)

(72) Inventors: John Robert Burt, Brentwood, TN (US); Lee Shuttleworth, Brentwood, TN (US)

(73) Assignee: Pride Manufacturing Company, LLC, Brentwood, TN (US)

( * ) Notice: Subject to any disclaimer, the term of this patent is extended or adjusted under 35 U.S.C. 154(b) by 0 days.

(21) Appl. No.: 17/393,092

(22) Filed: Aug. 3, 2021

(65) Prior Publication Data

US 2021/0362223 A1 Nov. 25, 2021

Related U.S. Application Data

(63) Continuation-in-part of application No. 16/290,460, filed on Mar. 1, 2019, now abandoned.

(60) Provisional application No. 62/637,259, filed on Mar. 1, 2018.

(51) Int. Cl.

| | |
|---|---|
| ***B22D 19/00*** | (2006.01) |
| ***B22D 17/24*** | (2006.01) |
| ***A43C 15/16*** | (2006.01) |

(52) U.S. Cl.

CPC ..... *B22D 19/00* (2013.01); *B22D 17/24* (2013.01); *A43C 15/161* (2013.01)

(58) Field of Classification Search

CPC .... A43C 15/161; A43C 15/162; A43C 15/167

See application file for complete search history.

(56) References Cited

U.S. PATENT DOCUMENTS

| | | | | |
|---|---|---|---|---|
| 1,559,086 | A | 10/1925 | Golden | |
| 1,873,904 | A | 8/1932 | Pierce | |
| 2,185,397 | A | 1/1940 | Birchfield | |
| 2,276,887 | A | 3/1942 | Tucker | |
| 2,292,239 | A | 8/1942 | Pierce | |
| 2,294,462 | A * | 9/1942 | King ..... | A43C 15/161 36/67 D |
| 2,682,714 | A | 7/1954 | Phillips | |
| 2,787,843 | A | 4/1957 | Phillips | |
| 3,054,197 | A | 9/1962 | Gerard et al. | |
| 3,133,364 | A | 5/1964 | Wormelle | |
| 3,413,737 | A | 12/1968 | Kneebusch | |

(Continued)

FOREIGN PATENT DOCUMENTS

| | | | |
|---|---|---|---|
| DE | 2618520 | A1 | 11/1977 |
| DE | 2638570 | A1 | 3/1978 |

(Continued)

OTHER PUBLICATIONS

Office Action dated Feb. 2, 2022 in related U.S. Appl. No. 16/903,643.

(Continued)

*Primary Examiner* — Jacob J Cigna

(74) *Attorney, Agent, or Firm* — Polsinelli PC

(57) ABSTRACT

Various embodiments for a traction element used with athletic shoes having a stud body with a metal insert that extends axially from the stud body and methods for manufacturing such traction elements are disclosed.

15 Claims, 25 Drawing Sheets

(56) References Cited

U.S. PATENT DOCUMENTS

| | | | | |
|---|---|---|---|---|
| 3,538,970 | A | 11/1970 | Shwayder | |
| 3,656,245 | A | 4/1972 | Wilson | |
| 4,014,114 | A * | 3/1977 | Jordan | A43C 15/162 36/67 D |
| 4,146,979 | A | 4/1979 | Fabbrie | |
| 4,466,205 | A | 8/1984 | Corbari | |
| 4,472,098 | A | 9/1984 | Kiefer | |
| 4,723,366 | A | 2/1988 | Hagger | |
| 5,036,606 | A | 8/1991 | Erich et al. | |
| 5,926,980 | A | 7/1999 | Adam | |
| 5,964,048 | A | 10/1999 | Shieh | |
| 5,996,260 | A | 12/1999 | MacNiell | |
| 6,381,878 | B1 | 5/2002 | Kennedy | |
| 7,047,674 | B1 | 5/2006 | Garvie | |
| 7,552,550 | B2 | 6/2009 | Maffeis | |
| 9,833,044 | B2 * | 12/2017 | Baucom | A43C 15/161 |
| 2002/0133978 | A1 | 9/2002 | Liao | |
| 2005/0160629 | A1 | 7/2005 | Jungkind | |
| 2007/0172331 | A1 | 7/2007 | Chang | |
| 2012/0266490 | A1 | 10/2012 | Atwal et al. | |
| 2013/0305567 | A1 | 11/2013 | Johnson | |
| 2016/0192742 | A1 | 7/2016 | Baucom | |
| 2019/0269204 | A1 | 9/2019 | Burt | |

FOREIGN PATENT DOCUMENTS

| | | | |
|---|---|---|---|
| DE | 2810363 | A1 | 9/1979 |
| FR | 2362685 | A1 | 3/1978 |
| FR | 2398471 | A1 | 2/1979 |
| FR | 2532825 | A1 | 3/1984 |
| GB | 2098457 | A | 11/1982 |
| JP | 2011200355 | A | 10/2011 |
| WO | 9715206 | A1 | 5/1997 |

OTHER PUBLICATIONS

International Search Report and Written Opinion issued in corresponding Application No. PCT/US2021/037741 dated Oct. 1, 2021, 11 pages.

Written Opinion of the International Searching Authority issued in corresponding International Application No. PCT/US2019/020331 dated Sep. 1, 2020, 8 pages.

Japan Patent Office, Notice of Reasons for Rejection (Office Action), Application No. 2020-568941, dated Dec. 20, 2022, 7 pages.

European Patent Office, Extended European Search Report, Application No. 22187744.2, dated Jan. 9, 2023, 7 pages.

* cited by examiner

3. Tool Closed

2. Insert Loaded

1.Tool Open

6. Ejection Forward

5. Tool Opened

4. Cavity Filled

9. Finished Part

8. Part Collected

7. Ejection Back

5. Tool Opened

3. Tool Closed

1.Tool Open

7. Ejection Back

6. Ejection Forward

METHOD FOR MANUFACTURING A TRACTION ELEMENT USING A CORING PROCESS

CROSS REFERENCED TO RELATED APPLICATIONS

This is a continuation-in-part of U.S. non-provisional application Ser. No. 16/290,460 filed on Mar. 1, 2019 that claims benefit to U.S. provisional application Ser. No. 62/637,259 filed on Mar. 1, 2018, which is herein incorporated by reference in its entirety.

FIELD

The present disclosure generally relates to traction elements for shoes, and particularly to a method of manufacturing a traction element using a coring process.

BACKGROUND

Traction elements for athletic shoes are used to provide a gripping surface that produces traction between the sole of the shoe and the athletic surface, such as a grass field. Typically, traction elements for athletic shoes used in sports, such as rugby, use metal studs made of a metallic material to accommodate the high shear forces applied to the metal studs during play. As such, it is desirable to improve on conventional methods of manufacturing such traction elements, while still meeting all the performance, shape specifications and material requirements required by various official sports authorities.

Current technologies tend to rely on boring or drilling out material from within a formed stud body following casting in order to remove excess material from the traction element. This process can be time-consuming when waiting for a formed stud body to cool, and can waste material when drilling, boring, or otherwise removing casted material from the stud body. Further, a boring or drilling step can require an extra step in the manufacturing process and can also require regular sharpening or replacing of drilling or boring tools.

It is with these observations in mind, among others, that various aspects of the present disclosure were conceived and developed.

BRIEF DESCRIPTION OF THE DRAWINGS

Corresponding reference characters indicate corresponding elements among the view of the drawings. The headings used in the figures do not limit the scope of the claims.

DETAILED DESCRIPTION

Figure 1:
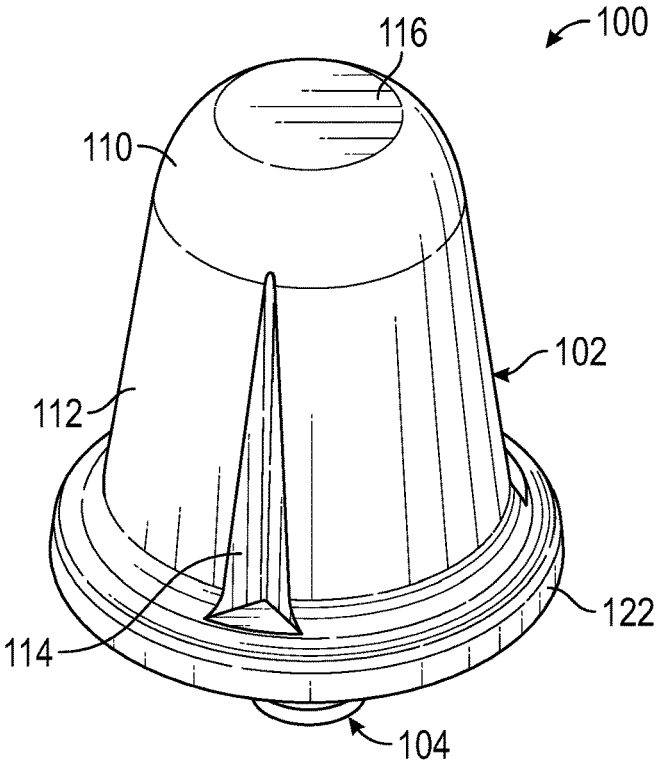
FIG. 1 is a top perspective view of a first embodiment of a traction element showing the stud body and metal insert.
Figure 2:
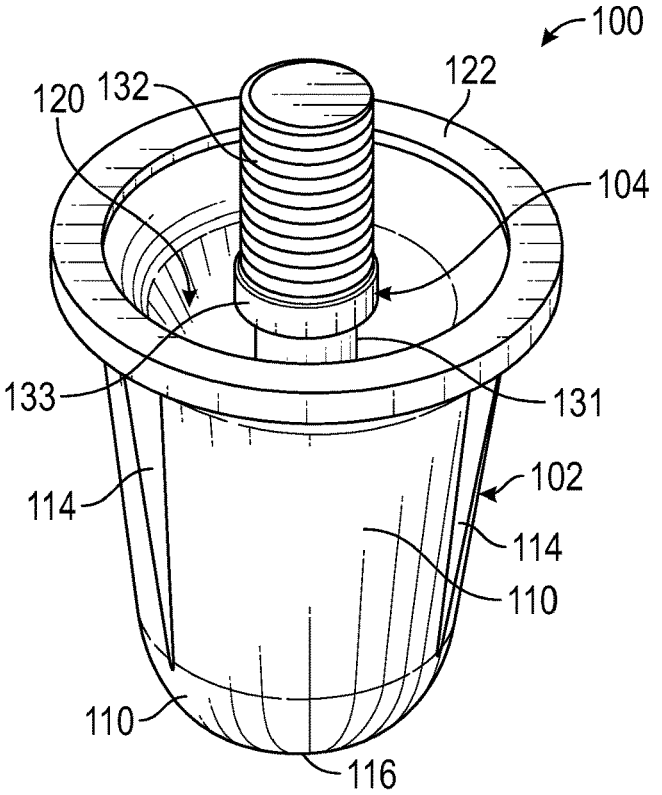
FIG. 2 is a rear perspective view of the traction element of FIG. 1 showing the metal insert extending from the interior cavity of the stud body.
Figure 3:
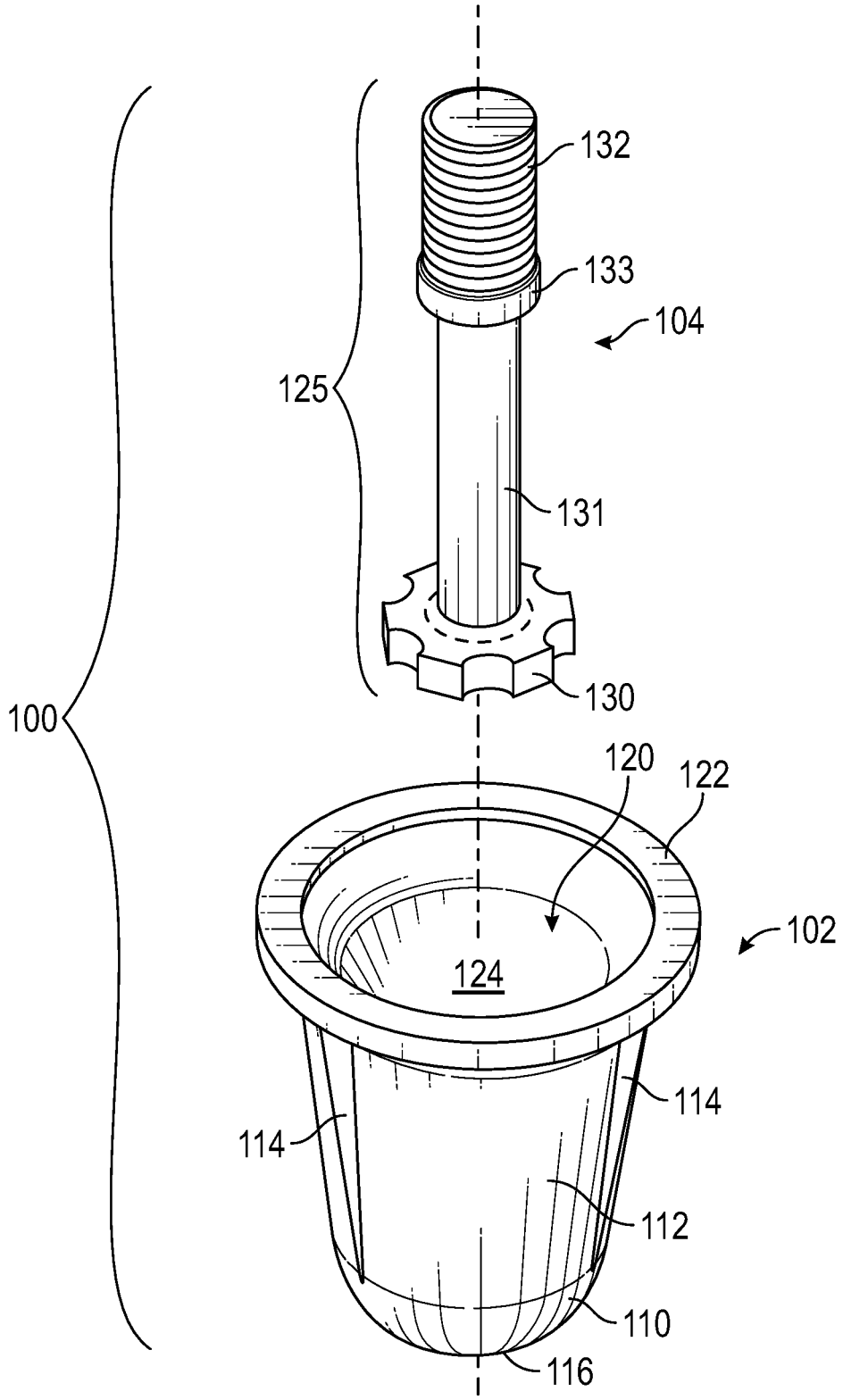
FIG. 3 is an exploded view of the traction element of FIG. 1.
Figure 6:
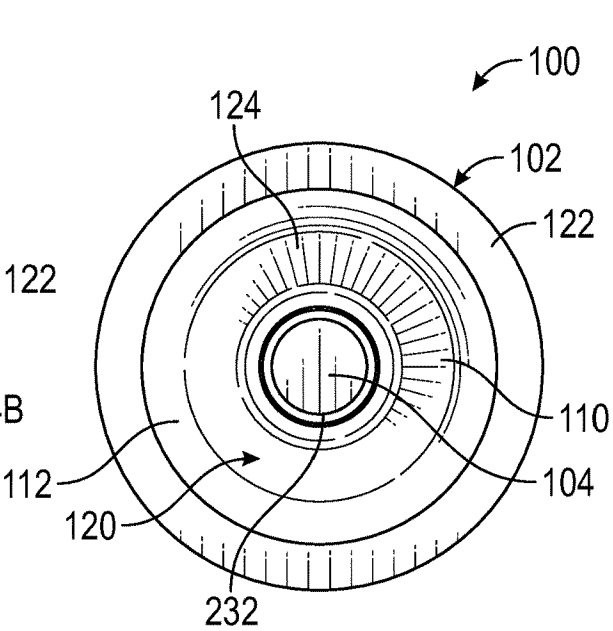
FIG. 6 is a bottom view of the traction element of FIG. 1.

Various embodiments for traction elements used for athletic shoes are disclosed herein. In some embodiments, the traction elements have reduced weight while still meeting existing industry performance standards for athletic shoes. In some embodiments, the traction element includes a stud body defining an interior cavity with a metal insert that is cast to the stud body and extends outwardly from hollow cavity. In some embodiments, the metal insert of the traction element is configured to be coupled to the sole of an athletic shoe for providing traction. In some embodiments, a method of manufacturing the traction element such that the metal insert is either cast to the stud body or mechanically coupled to the stud body prior to being engaged to the sole of an athletic shoe is disclosed. In one aspect, the stud body can be manufactured using a novel coring process in which a casting material is injected into a casting cavity around the metal insert. The interior cavity of the stud body is formed during the coring process by a core steel component. The casting material fills the casting cavity around the core steel component, thus forming the interior cavity of the traction element by coring rather than boring or drilling away at the stud body to remove casting material. In some embodiments, the metal insert includes a bulbous middle portion that engages a plastic or like material retainer within the interior cavity of the stud body to provide further structural integrity between the metal insert and the stud body when the traction element is engaged to an athletic shoe. In one aspect, the traction element meets the current standards required of official governing sports bodies, such as the ROC, which governs international rugby regarding the performance, shape and material requirements set for athletic equipment, such as rugby studs used in athletic shoes including the traction element described herein. Referring to the drawings, various embodiments of a traction element used with athletic shoes are illustrated and generally indicated as 100, 200 and 300 in FIGS. 1-21. Various embodiments of a method of manufacturing the traction element are illustrated and generally indicated as 700 and 800 in FIGS. 22-31.

Referring to FIGS. 1-7, a first embodiment of the traction element, designed 100, is illustrated. In some embodiments, the traction element 100 includes a stud body 102 having a generally thimble-shaped body configured to provide traction and gripping strength along a ground surface when attached to the sole of an athletic shoe. In some embodiments, the stud body 102 includes a metal insert 104 that is cast to the stud body 102 during manufacture and is aligned along the longitudinal axis A of the stud body 102. The metal insert 104 is configured to mechanically couple the traction element 100 to the sole of an athletic shoe (not shown). Referring specifically to FIGS. 2-4, 6 and 7, the stud body 102 defines a distal head portion 110 and a proximal end portion 112. In some embodiments, the proximal end portion 112 of the stud body 102 gradually tapers away from the distal head portion 110 and forms a peripheral flange 122 that defines an opening 118 in communication with an interior cavity 120 formed within the stud body 102 during manufacture. As further shown, the distal head portion 110 defines a top end 116 of the traction element 100 that is configured to provide a traction surface along the sole of an athletic shoe (not shown) when the traction element 100 engages the ground or other athletic surface.

Figure 7:
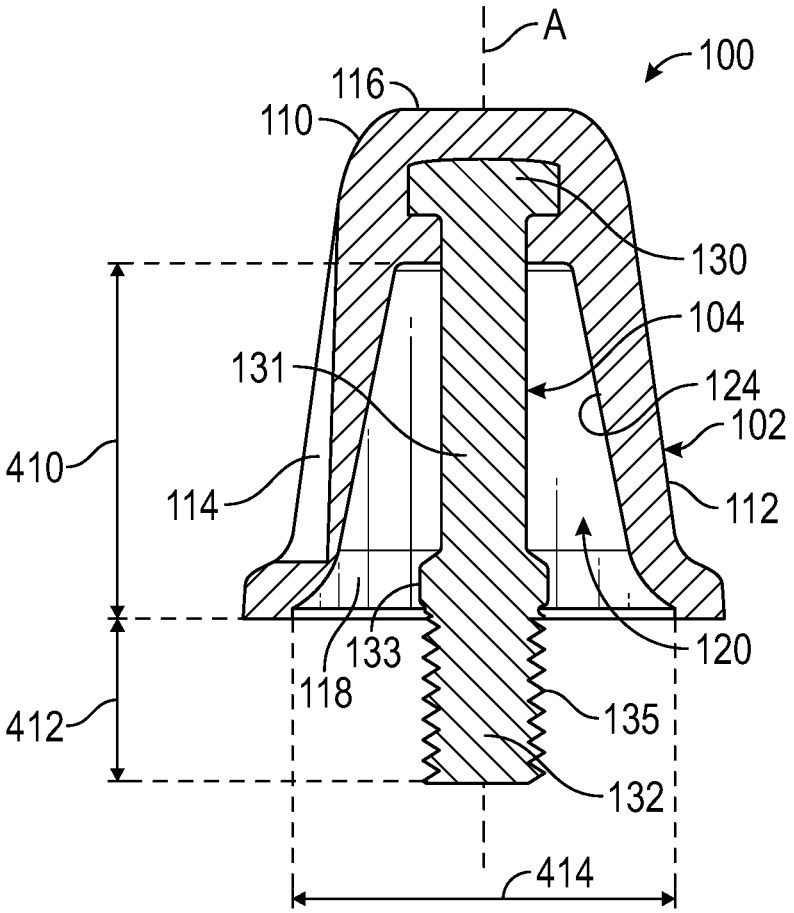
FIG. 7 is a cross-sectional view of the traction element taken along line 7-7 of FIG. 5.
Figure 8:
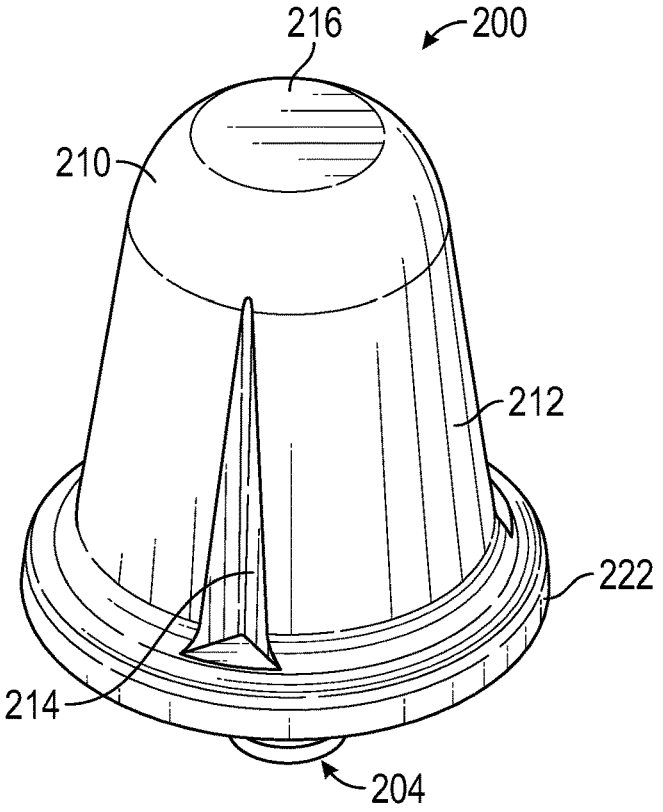
FIG. 8 is a top perspective view of a second embodiment of a traction element showing the stud body and metal insert.

Referring to FIG. 7, in some embodiments the metal insert 104 is made of steel and/or aluminum that forms an elongated body 125 defining a distal cap 130, which is cast to the stud body 102 during manufacture. In addition, the distal cap 130 communicates with a shaft portion 131 of the metal insert 104 that extends between the distal cap 130 and a proximal threaded portion 132 of the metal insert 104. As shown, the proximal threaded portion 132 defines external threads 135 configured to couple with internal threads (not shown) formed within each respective threaded engagement point defined along the sole of an athletic shoe (not shown). In some embodiments, the metal insert 104 further defines a bulbous portion 133 that is formed between the shaft portion 131 and the proximal threaded portion 132 that provides an engagement surface for a retainer or liner disposed inside the internal cavity 120 to provide structural reinforcement between the stud body 102 and the metal insert 104 as shall be discussed in greater detail below with respect to traction element 200.

Figure 5:
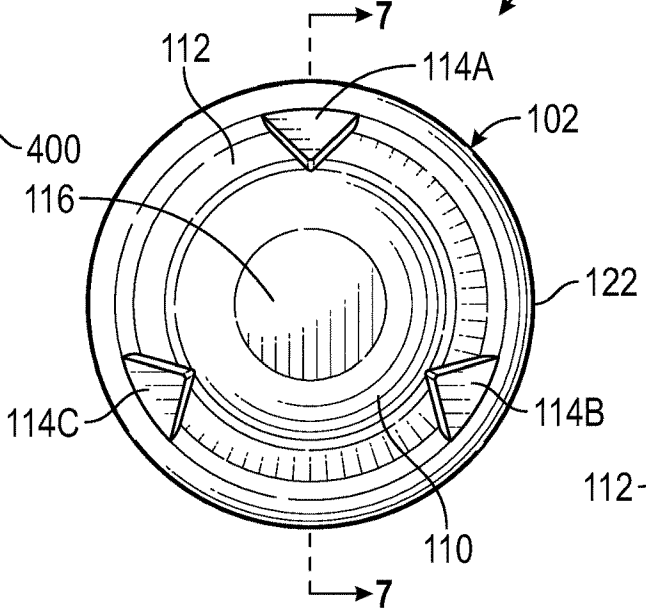
FIG. 5 is a top view of the traction element of FIG. 1.
Figure 4:
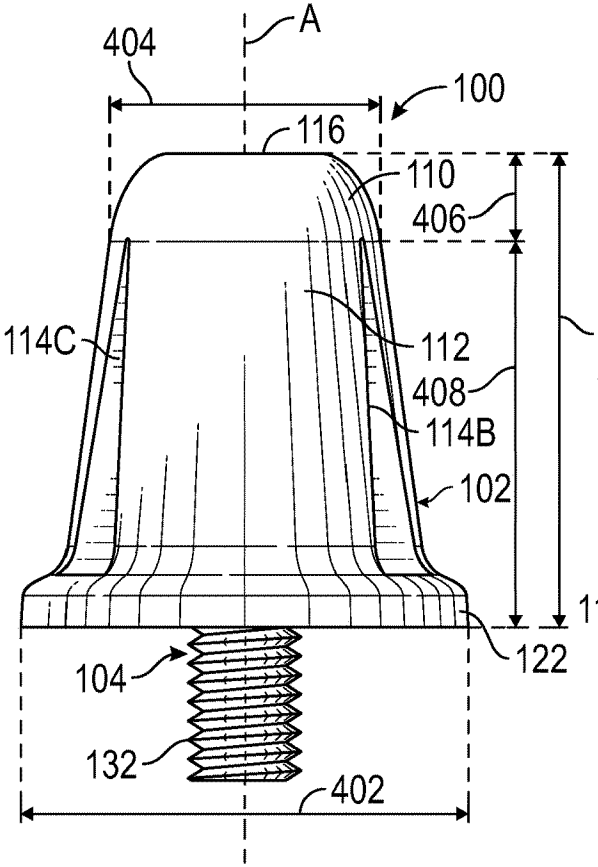
FIG. 4 is a side view of the traction element of FIG. 1.

As shown specifically in FIGS. 4 and 5, in some embodiments a plurality of cutaways 114 may be formed axially along the outer surface of the stud body 102. The plurality of cutaways 114 may be collectively configured to receive a driving tool (not shown), such as a cleat wrench, that engages each respective cutaway 114 such that rotation of the cleat wrench causes the stud body 102 to be manually rotated as the metal insert 104 becomes fully engaged to the threaded engagement point along the sole of the athletic shoe. Referring specifically to FIG. 5, in some embodiments the stud body 102 may define three respective cutaways, 114A, 114B and 114C that each extend a distance axially along the surface of proximal end portion 112 of the stud body 102 and are spaced equidistantly relative to each other at a 120 degree angle. In other embodiments, two or more cutaways 114 may be formed to engage the cleat wrench when securing the traction element 100 to the sole of the athletic shoe. In some embodiments, each cutaway 114 forms an elongated slot configuration forming a base proximate the peripheral flange 122 of the stud body 102 that extends the length of the proximal end portion 112 and gradually tapers to an apex formed at the top of each cutaway 114. In other embodiments, the plurality of cutaways 114 may define a triangularly-shaped slot, a rectangular-shaped slot, a symmetrically-shaped slot, an asymmetrically-shaped slot, a circular-shaped slot, or a combination thereof.

In one method of manufacturing the traction element 100, the stud body 102 may be first cast from a metallic material, such as aluminum, in which the metal insert 104 is directly cast to the stud body 102 such that the proximal threaded portion 132 of the metal insert 104 extends partially outward from the cast of the stud body 102. The interior cavity 120 is formed inside the stud body 102 by coring the interior portion of the stud body 102 around the metal insert 104 to form the interior cavity 120 and, in some embodiments, an opening 118 according to method 800 as is discussed in FIGS. 22-31. In some embodiments, the plurality of cutaways 114 are formed when the stud body 102 is cast within a mold, or in the alterative, the plurality of cutaways 114 may be machined out along the surface of the proximal end portion 112 after the cast of the stud body 102 is allowed to sufficiently cool. The method of manufacturing the traction element 100 as disclosed herein provides a strong structural connection between the stud body 102 and the metal insert 104 such that shear forces applied to the traction element 100 during use do not cause the metal insert 104 to break, bend or twist relative to the stud body 102.

In one aspect, the coring out of stud body 102 to form the interior cavity 120 during manufacture reduces the overall weight and cooling time of the traction element 100 while still allowing the traction element 100 to meet all performance, shape specifications and material requirements required of a conventional traction element.

In some embodiments, the traction element 100 may be manufactured with the following dimensions used during manufacture. Referring to FIG. 4, the stud body 102 may have an overall length 400 of 20.8 mm and a width 402 of 19.4 mm. As further shown, the distal head portion 110 of the stud body 102 may have a width 404 of 11.9 mm and a length 406 of 4 mm, while the proximal end portion 112 of the stud body 102 may have a length 408 of 16.8 mm and a width 402 of 20.8 mm. Referring back to FIG. 7, the interior cavity 120 of the stud body 102 may have a length 410 of 14.6 mm and the opening 118 of the interior cavity 120 may have a length 414 of 9.0 mm. After the metal insert 104 is cast with the stud body 102, the proximal threaded portion 132 of the metal insert 104 is centered along the longitudinal axis A of the stud body 102 and extends outwardly from the opening 118 of the stud body 102 at a distance 412 of 6.0 mm. The present disclosure contemplates that the dimensions of the stud body 102 and the metal insert 104 may vary to accommodate different shapes and sizes of traction elements used for different types of athletic shoes.

Referring to FIGS. 9-14, a second embodiment of the traction element, designated 200, is illustrated. In some embodiments, the traction element 200 includes a hollow stud body 202 having a generally thimble-shaped body configured to provide traction and gripping strength along a ground surface when attached to the sole of an athletic shoe. In some embodiments, the stud body 202 includes a metal insert 204 that is cast to the stud body 202 during manufacture and is aligned along the longitudinal axis A of the stud body 202. The metal insert 204 is configured to mechanically couple the traction element 200 to the sole of an athletic shoe (not shown). Referring specifically to FIGS. 10-12, 13 and 14, the stud body 202 defines a distal head portion 210 and a proximal end portion 212. In some embodiments, the proximal end portion 212 of the stud body 202 gradually tapers away from the distal head portion 210 and forms a peripheral flange 222 that defines an opening 218 in communication with an interior cavity 220 defining an interior surface 224 formed within the stud body 202. As further shown, the distal head portion 210 defines a top end 216 of the traction element 200 that is configured to provide a traction surface along the sole of the athletic shoe when the traction element 200 engages the ground or other athletic surface.

Figure 9:
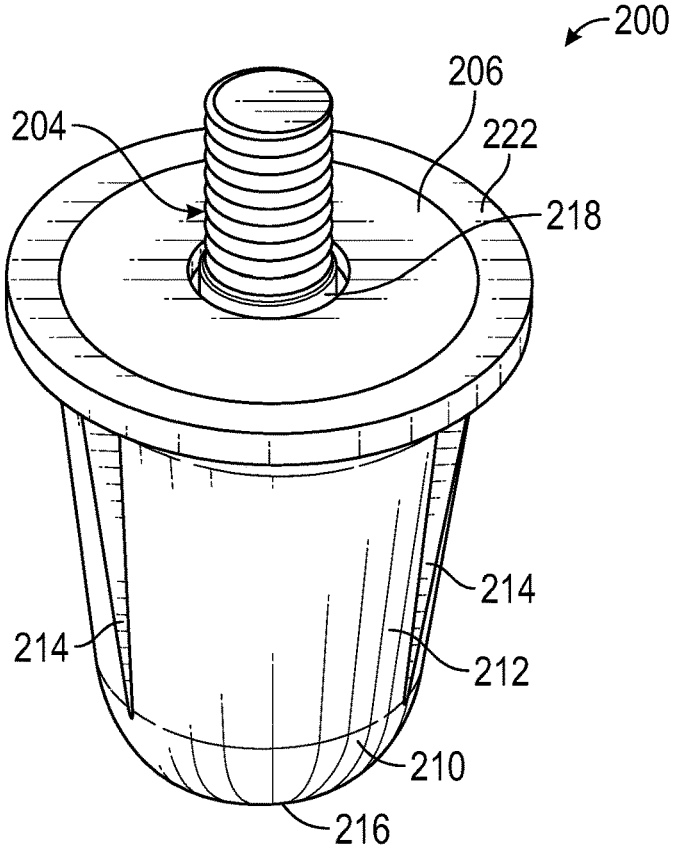
FIG. 9 is a rear perspective view of the traction element of FIG. 8 showing the metal insert extending from the interior cavity of the stud body.
Figure 10:
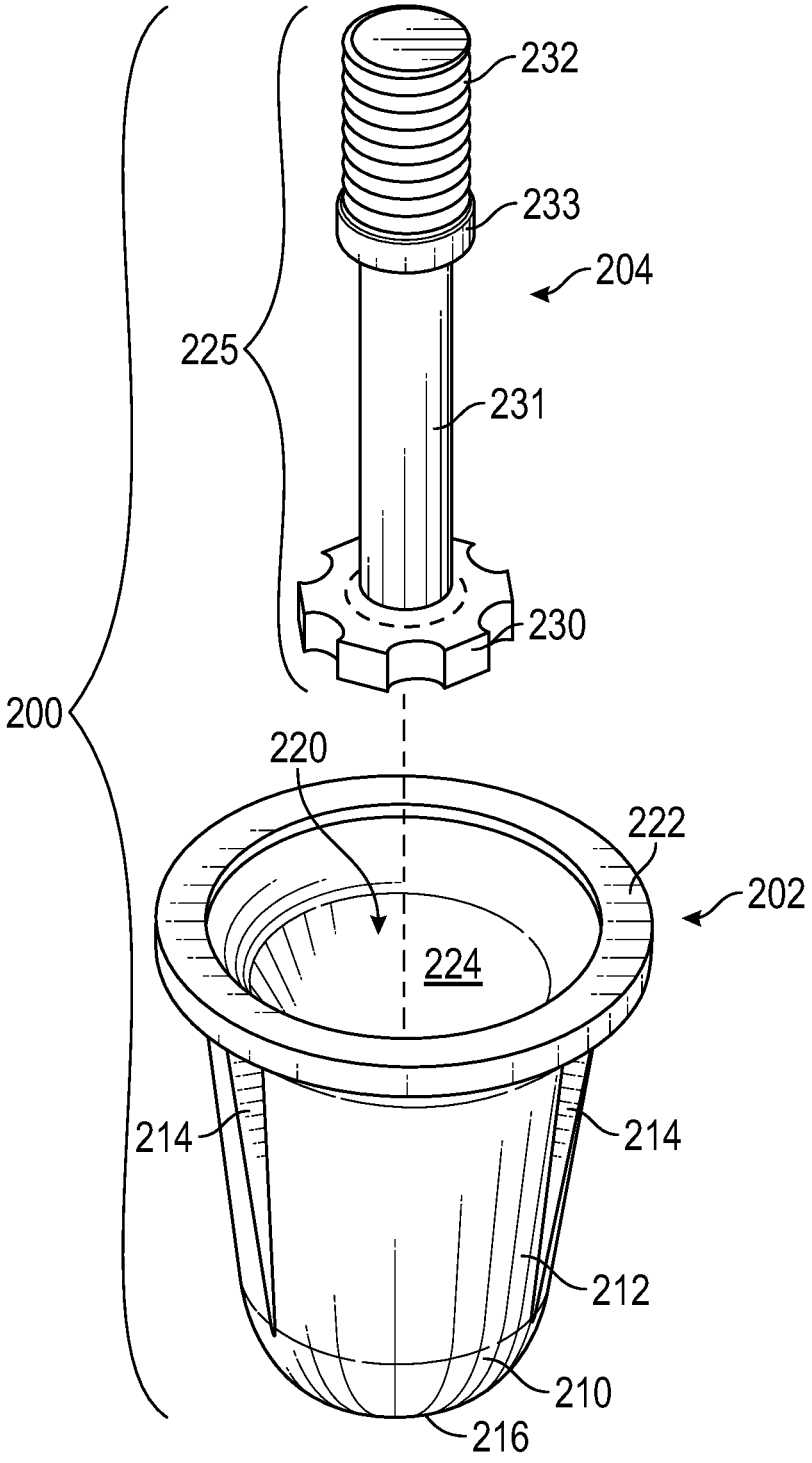
FIG. 10 is an exploded view of the traction element of FIG. 8.
Figure 13:
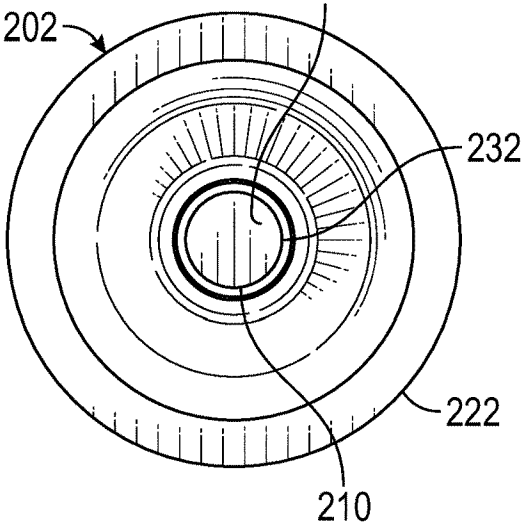
FIG. 13 is a bottom view of the traction element of FIG. 8.
Figure 14:
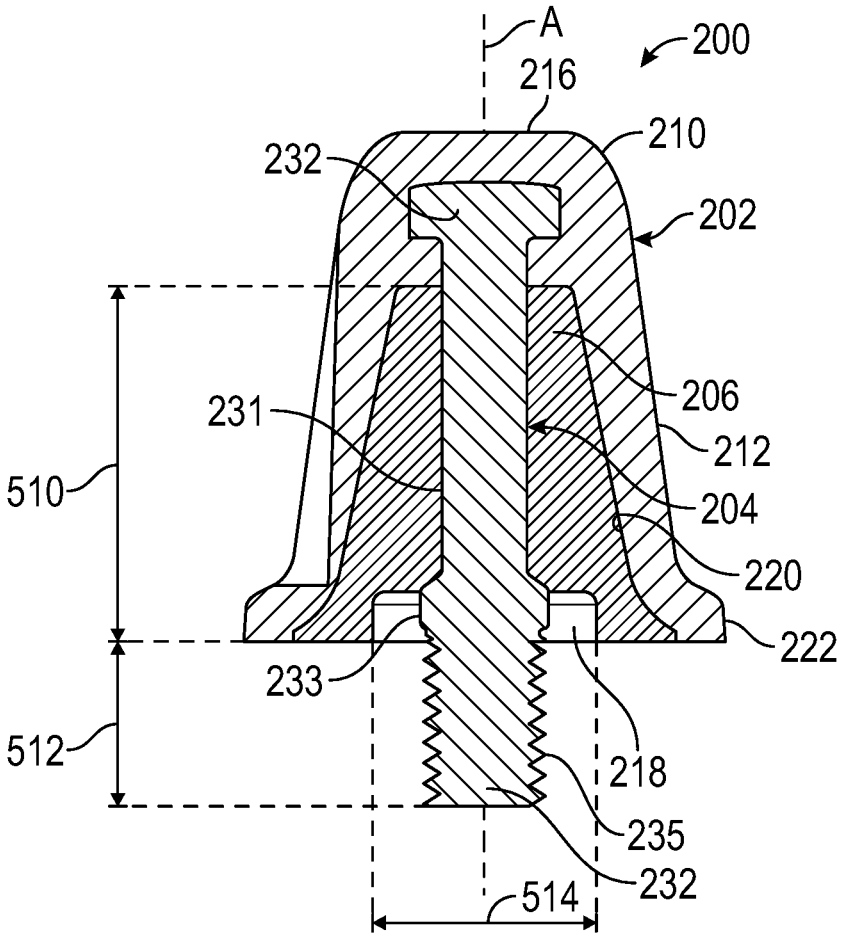
FIG. 14 is a cross-sectional view of the traction element taken along line 14-14 of FIG. 12.
Figure 15:
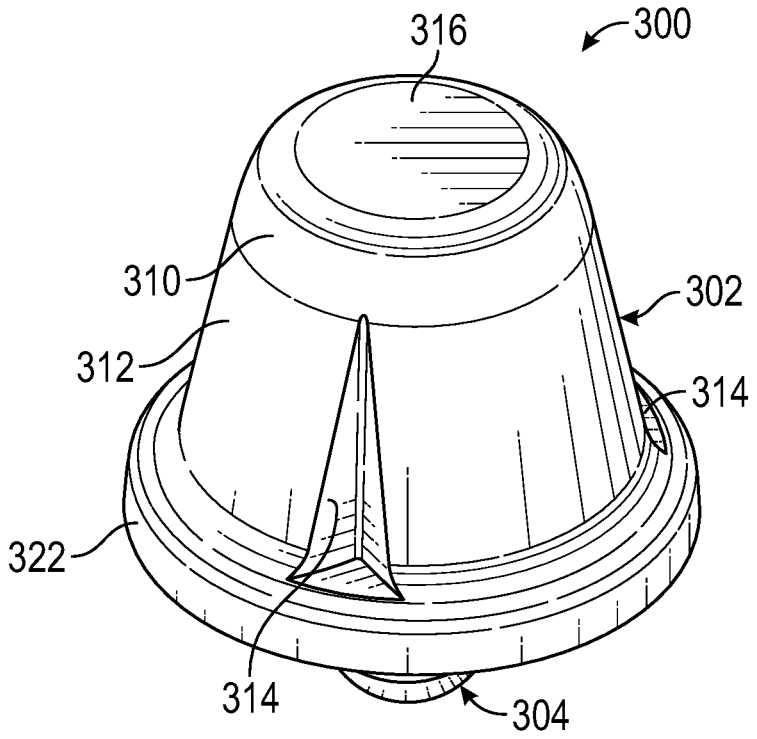
FIG. 15 is top perspective view of a third embodiment of a traction element showing the stud body and metal insert.
Figure 16:
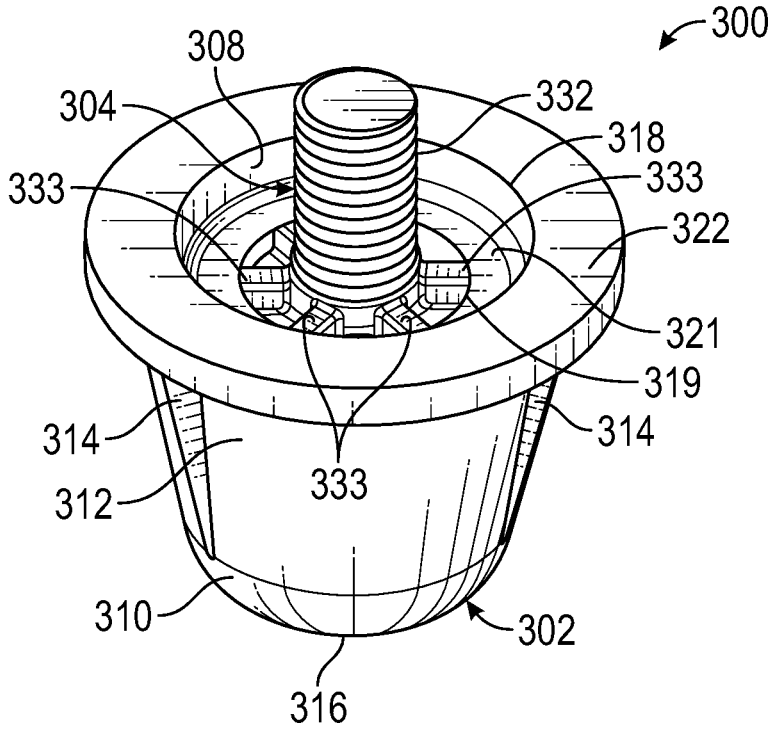
FIG. 16 is a rear perspective view of the traction element of FIG. 15 showing the steel insert extending from the cavity of the traction element.

Referring to FIG. 14, in some embodiments the metal insert 204 is made of steel and/or aluminum that forms an elongated body 225 defining a distal cap 230, which is cast to the stud body 202 during manufacture. In addition, the distal cap 230 communicates with a shaft portion 231 of the metal insert 204 that extends between the distal cap 230 and a proximal threaded portion 232 of the metal insert 204. As shown, the proximal threaded portion 232 defines external threads 235 configured to couple with internal threads (not shown) formed within each respective engagement point defined along the sole of an athletic shoe (not shown). As shown in FIGS. 9 and 14, in some embodiments the metal insert 204 further defines a bulbous portion 233 that is formed between the shaft portion 231 and the proximal threaded portion 232 and provides an engagement surface for contacting a retainer 206 made of a filler material, such as nylon, that is disposed inside the interior cavity 220 during manufacture. The retainer 206 is configured to provide further structural reinforcement between the stud body 202 and the metal insert 204 as shall be discussed in greater detail below.

Figure 12:
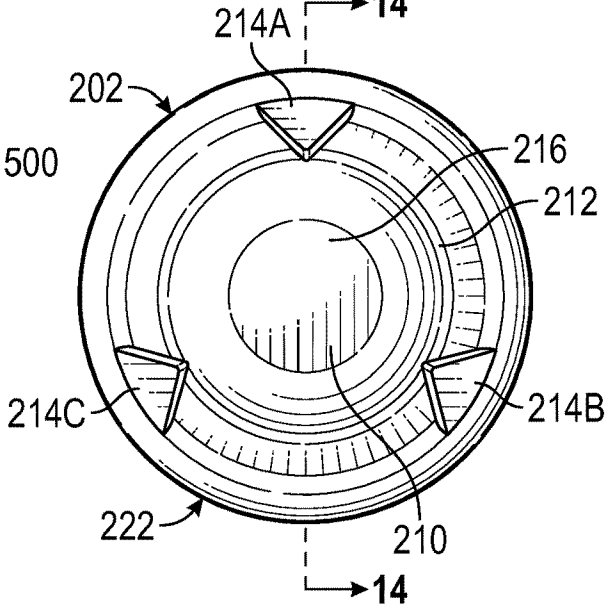
FIG. 12 is a top view of the traction element of FIG. 8.
Figure 11:
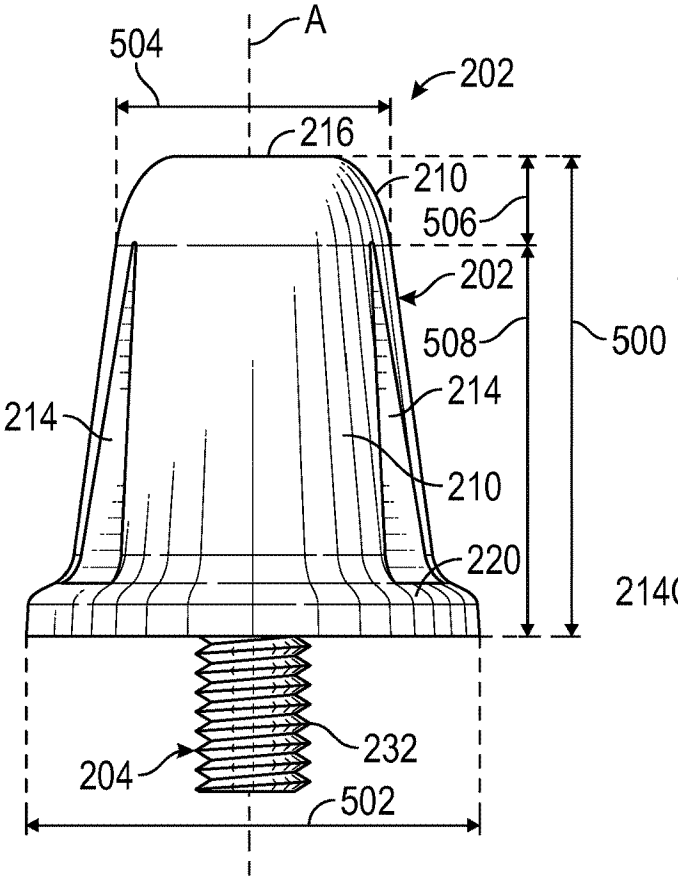
FIG. 11 is a side view of the traction element of FIG. 8.

As shown specifically in FIGS. 11 and 12, in some embodiments a plurality of cutaways 214 may be formed axially along the outer surface of the stud body 202. The plurality of cutaways 214 may be collectively configured to receive a driving tool (not shown), such as a cleat wrench, that engages each respective cutaway 214 such that rotation of the driving tool causes the stud body 202 to be manually rotated as the metal insert 204 becomes fully engaged to the sole of the athletic shoe. Referring specifically to FIG. 12, in some embodiments the stud body 202 may define three respective cutaways, 214A, 214B and 214C that each extend a distance axially along the surface of proximal end portion 212 and are spaced equidistantly relative to each other at a 120 degree angle. In other embodiments, two or more cutaways 214 may be formed along the stud body 202 to engage the driving tool when coupling the traction element 200 to the sole of the athletic shoe. In some embodiments, each cutaway 214 forms an elongated slot configuration forming a base proximate the peripheral flange 222 of the stud body 202 and two opposing sides that extend the length of the proximal end portion 212 and gradually taper to an apex formed at the top of each cutaway 214. In other embodiments, the plurality of cutaways 214 may define a triangularly-shaped slot, a rectangular-shaped slot, a symmetrically-shaped slot, an asymmetrically-shaped slot, a circular-shaped slot, or a combination thereof.

In one method of manufacture, the stud body 202 of the traction element 200 may be cast from a metallic material, such as aluminum, in which the metal insert 204 is directly cast to the stud body 202 such that the proximal threaded portion 232 of the metal insert 204 extends partially outward from the cast of the stud body 202. The interior cavity 220 is formed inside the stud body 202 by coring out the interior portion of the stud body 202 around the metal insert 204 to form the interior cavity 220 and in some embodiments, the opening 218 according to method 800 as is illustrated in FIGS. 22-31. Once the interior cavity 220 is formed, nylon or other type of filler material to form the retainer 206 is injected, poured or inserted into interior cavity 220 that surrounds the metal insert 204 to provide further structural integrity between the stud body 202 and the metal insert 204. During the injection of the filler material into the interior cavity 220, the bulbous portion 233 is configured to provide a retention feature that adds further structural reinforcement between the stud body 202 and the metal insert 204. In some embodiments, the plurality of cutaways 214 are formed when the stud body 202 is cast within a mold, or in the alterative, the plurality of cutaways 214 may be machined out along the surface of the proximal end portion 212 after the cast of the stud body 202 is allowed to sufficiently cool. The method of manufacturing the traction element 200 as disclosed herein provides a strong structural connection between the stud body 202 and the metal insert 204 such that shear forces applied to the traction element 200 during a sporting activity do not cause the metal insert 204 to break, bend or twist relative to the stud body 202.

In one aspect, as noted above the coring out of stud body 202 to form the interior cavity 220 during manufacture reduces the overall weight and cooling time of the traction element 200 while still allowing the traction element 200 to meet all performance, shape specifications and material requirements required of a conventional traction element for an athletic shoe.

In some embodiments, the traction element 200 may be manufactured with the following dimensions. Referring to FIG. 11, the stud body 202 may have an overall length 500 of 20.8 mm and a width 502 of 19.4 mm. As further shown, the distal head portion 210 of the stud body 202 may have a width 504 of 11.9 mm and a length 506 of 4.0 mm, while the proximal end portion 212 of the stud body 202 may have a length 508 of 16.8 mm and a width 502 of 20.8 mm. Referring back to FIG. 14, the hollow cavity 220 of the stud body 202 may have a length 510 of 14.6 mm and the opening 218 of the interior cavity 220 may have a length 514 of 9.0 mm. After the metal insert 204 is cast with the stud body 202 and the retainer 206 disposed within the internal cavity 220, the proximal threaded portion 232 of the metal insert 204 will be centered along the longitudinal axis A of the stud body 204 and extend outwardly from the opening 218 of the stud body 202 at a distance 512 of 6.0 mm. The present disclosure contemplates that the dimensions of the stud body 202 and the metal insert 204 may vary to accommodate different shapes and sizes of traction elements used for different types of athletic shoes.

Referring to FIGS. 15-21, a third embodiment of the traction element, designated 300, is illustrated. In some embodiments, the traction element 300 includes a stud body 302 having a generally thimble-shaped body configured to provide traction and gripping strength along a ground surface when attached to the sole of an athletic shoe. In some embodiments, the stud body 302 includes a metal insert 304 having a standard or reverse thread head that is driven and cuts the surface of the interior cavity 320 of the stud body 302 to establish a secure engagement between the distal cap 330 of the metal insert 304 and the stud body 302 during manufacture as shall be discussed in greater detail below. Similar to the other embodiments of the traction element 300, the metal insert 304 is configured to mechanically couple the traction element 300 to the sole of an athletic shoe (not shown). Referring to FIGS. 17-19, 20 and 21, the stud body 302 defines a distal head portion 310 and a proximal end portion 312. The proximal end portion 312 of the stud body 302 gradually tapers away from the distal head portion 310 and forms a peripheral flange 322 that defines an opening 318 in communication with an interior cavity 320 formed within the stud body 302. As further shown, the distal head portion 310 defines a top end 316 of the traction element 300 that is configured to provide a traction surface along the sole of an athletic shoe (not shown) when the traction element 300 engages the ground or other athletic surface.

Figure 17:
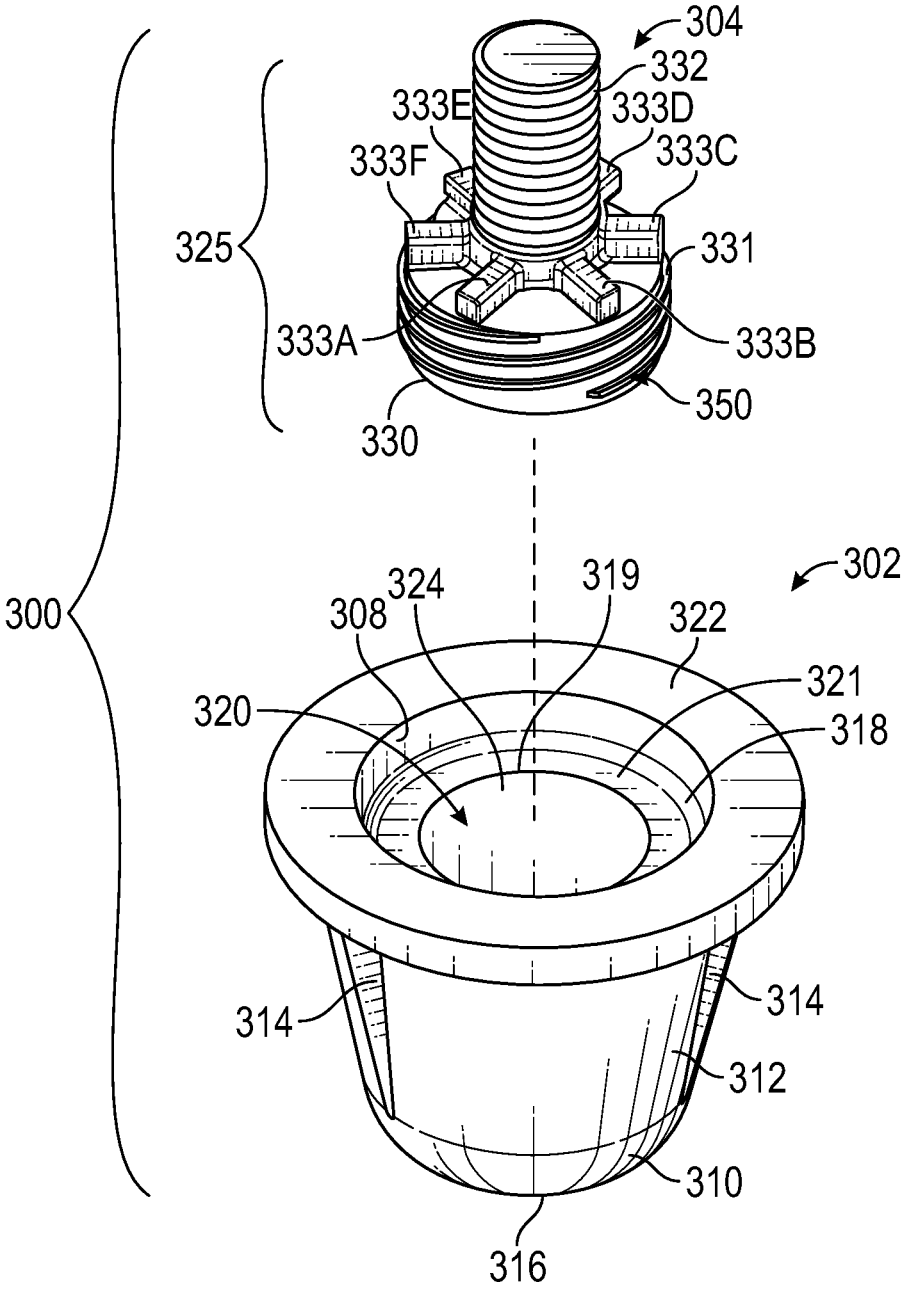
FIG. 17 is an exploded view of the traction element of FIG. 15.
Figure 20:
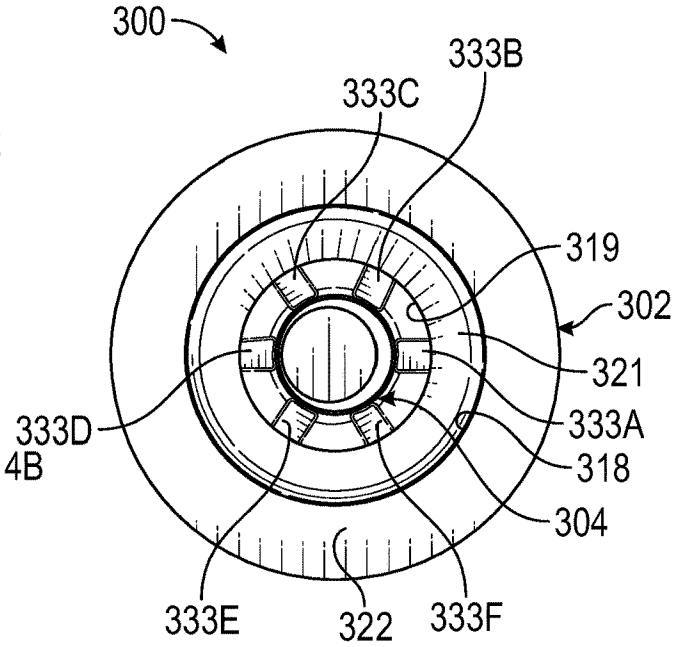
FIG. 20 is a bottom view of the traction element of FIG. 15.
Figure 21:
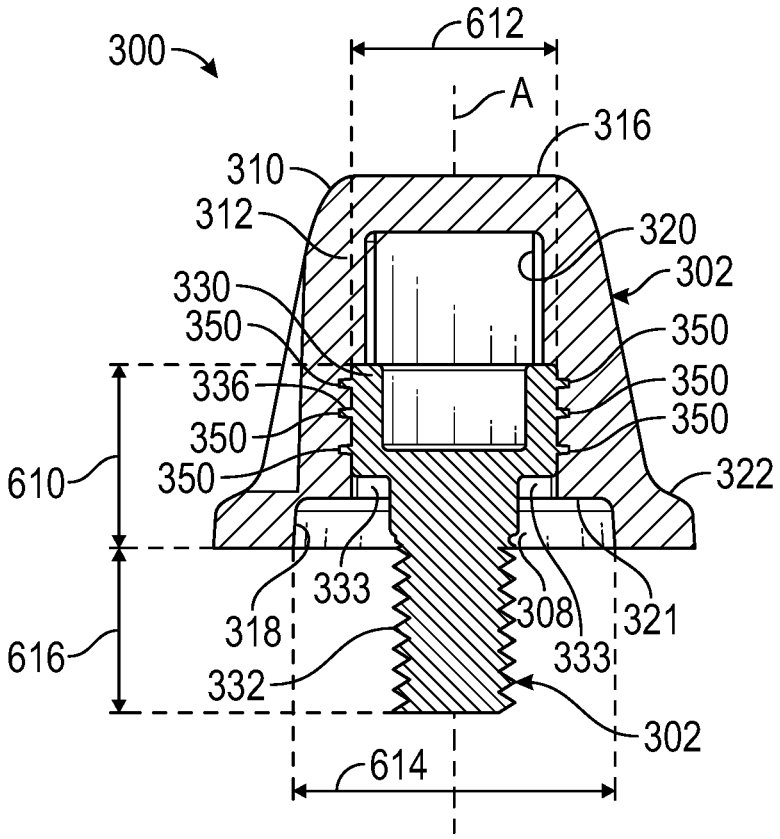
FIG. 21 is a cross-sectional view of the traction element taken along line 21-21 of FIG. 19.

Referring to FIGS. 17 and 21, in some embodiments the metal insert 304 is made of steel and/or aluminum that forms an insert body 325 defining a distal cap 330 and a proximal threaded portion 332 that extends axially from the distal cap 330. As noted above, the distal cap 330 forms external threads 350 that collectively form a standard or reverse thread head that may be driven into the interior cavity 320 of the stud body 302 such that the external threads 350 and insert internal threads 331 of the distal cap 330 cut directly into the interior surface of the stud body 302 to establish a secure engagement between the distal cap 330 of the metal insert 304 and the stud body 302 during manufacture. The interior cavity 320 defines a recess 308, a first opening of the stud body 318, a second opening of the stud body 319, a shoulder 321, and an interior surface 324. Once engaged to the stud body 302, the metal insert 304 should be centered and aligned along the longitudinal axis A of the stud body 302 and extends partially outward from the interior cavity 320 of the stud body 302. As further shown, the metal insert 304 forms a plurality of drive grippers 333A, 333B, 333C, 333D, 333E, 333F that extend radially extend outward from the proximal threaded portion 332 adjacent the distal cap 330 of the metal insert 304. The plurality of drive grippers 333A-F are configured to engage a drive tool (not shown) that allows the metal insert 304 to be driven into permanent engagement with the stud body 302 as shall be described in greater detail below.

Figure 19:
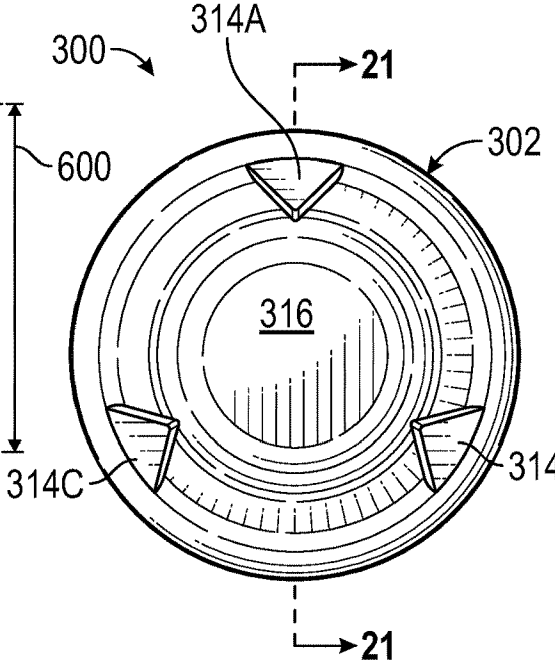
FIG. 19 is a top view of the traction element of FIG. 15.
Figure 18:
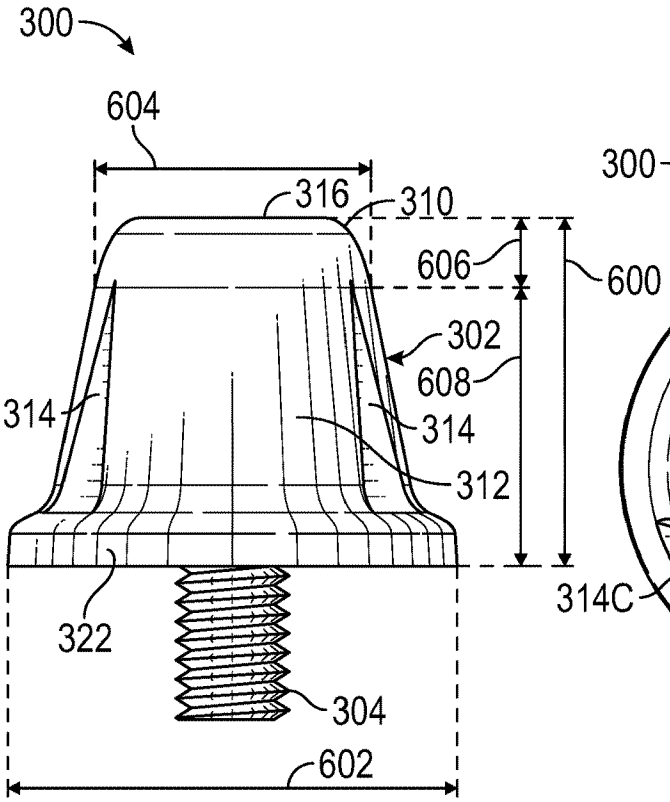
FIG. 18 is a side view of the traction element of FIG. 15.

As shown specifically in FIGS. 18 and 19, in some embodiments a plurality of cutaways 314 may be formed axially along the outer surface of the stud body 302. The plurality of cutaways 314 may be collectively configured to receive a driving tool (not shown), such as a cleat wrench, that engages each respective cutaway 314 such that rotation of the cleat wrench causes the stud body 302 to be manually rotated as the metal insert 304 becomes fully engaged to an engagement point formed along the sole of the athletic shoe. Referring specifically to FIG. 19, in some embodiments the stud body 302 may define three respective cutaways, 314A, 314B and 314C that each extend a distance axially along the surface of proximal end portion 312 of the stud body 302 and are spaced equidistantly relative to each other at a 120 degree angle. In other embodiments, two or more cutaways 314 may be formed along the stud body 302 to engage the cleat wrench when coupling the traction element 300 to the sole of the athletic shoe. In some embodiments, each cutaway 314 forms an elongated slot configuration forming a base proximate the peripheral flange 322 of the stud body 302 and two opposing sides that extend the length of the proximal end portion 312 and gradually taper to an apex formed at the top of each cutaway 314. In other embodiments, the plurality of cutaways 314 may define a triangularly-shaped slot, a rectangular-shaped slot, a symmetrically-shaped slot, an asymmetrically-shaped slot, a circular-shaped slot, or a combination thereof.

In one method of manufacture, the stud body 302 of the traction element 300 may be cast from a metallic material, such as aluminum. The interior cavity 320 is formed inside the stud body 302 by coring out the interior portion of the stud body 302 during manufacturing according to method 800 as is discussed in FIGS. 22-31. In other embodiments, the interior cavity 320 may be machined when the stud body 302 has cooled. Once the interior cavity 320 is formed, a drive tool (not shown) is used to engage the plurality of drive grippers 333 of the metal insert 302 which are then rotated by the drive tool when the metal insert 304 is manually driven into the interior cavity 320 of the stud body 302. The rotating action of the drive tool allows the external threads 350 of the metal insert 304 to act as a standard or reverse thread head that cuts directly into the interior surface of the stud body 302 to establish a secure engagement between the metal insert 304 and the stud body 302. The engagement between the metal insert 304 and the stud body 302 produces a strong structural connection between the metal insert 304 and the stud body 302 such that shear forces applied to the traction element 300 during a sporting activity do not cause the metal insert 304 to break, bend or twist relative to the stud body 302.

In some embodiments, the traction element 300 may be manufactured with the following dimensions used during manufacture. Referring to FIG. 18, the stud body 302 may have an overall length 600 of 15.0 mm and a width 602 of 16.0 mm. As further shown, the distal head portion 310 of the stud body 202 may have a width 604 of 12.2 mm and a length 606 of 4.0 mm, while the proximal end portion 312 of the stud body 302 may have a length 608 of 12.0 mm and a width 602 of 16.0 mm. Referring back to FIG. 21, the interior cavity 320 of the stud body 302 may have a length 610 of at least 7.5 mm and the opening 318 of the interior cavity 320 may have a length 614 of 13.0 mm. After the metal insert 304 is engaged with the stud body 302, the proximal threaded portion 332 of the metal insert 304 will be aligned along the longitudinal axis A of the stud body 302 and extend outwardly from the opening 318 of the stud body 302 at a distance 616 of 6.5 mm. At its widest point, the head of the metal insert 304 may have a width 612 of 8.5 mm. The present disclosure contemplates that the dimensions of the stud body 302 and the metal insert 304 may vary to accommodate different shapes and sizes of traction elements used for different types of athletic shoes.

Figure 29A:
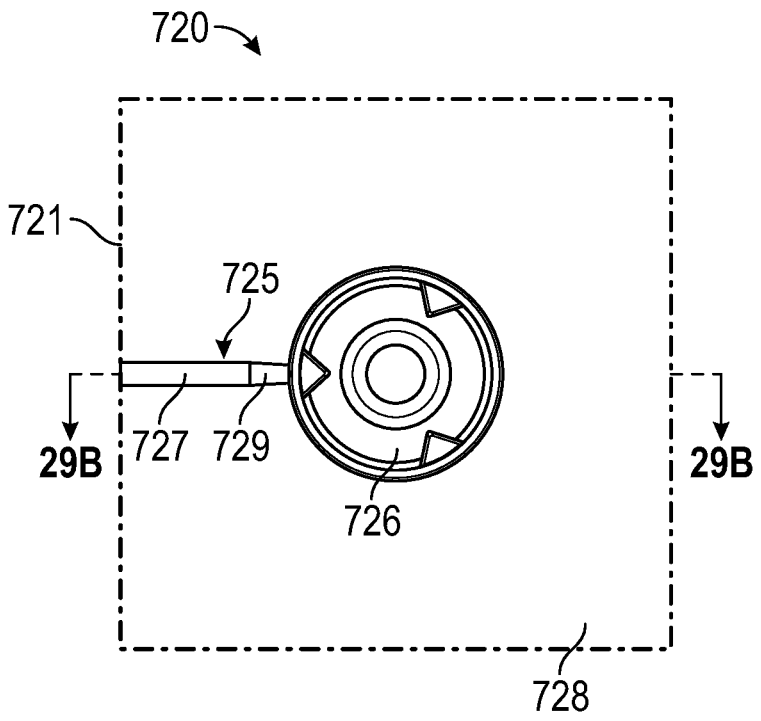
FIGS. 29A and 29B are respective below and cross-sectional isometric views showing an upper tool component of the tool apparatus of FIG. 22.
Figure 29B:
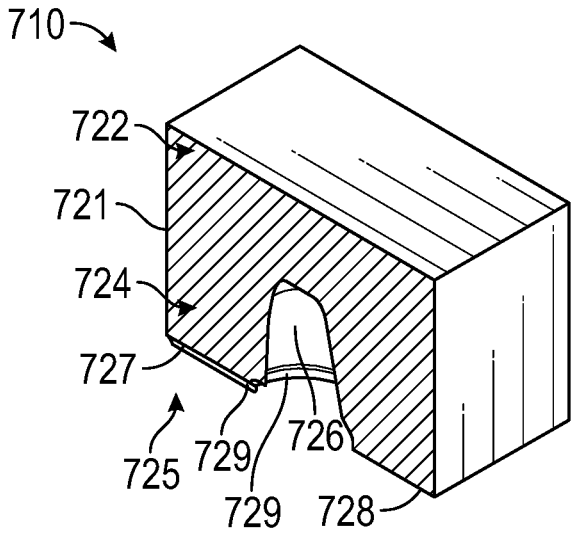
Figure 30:
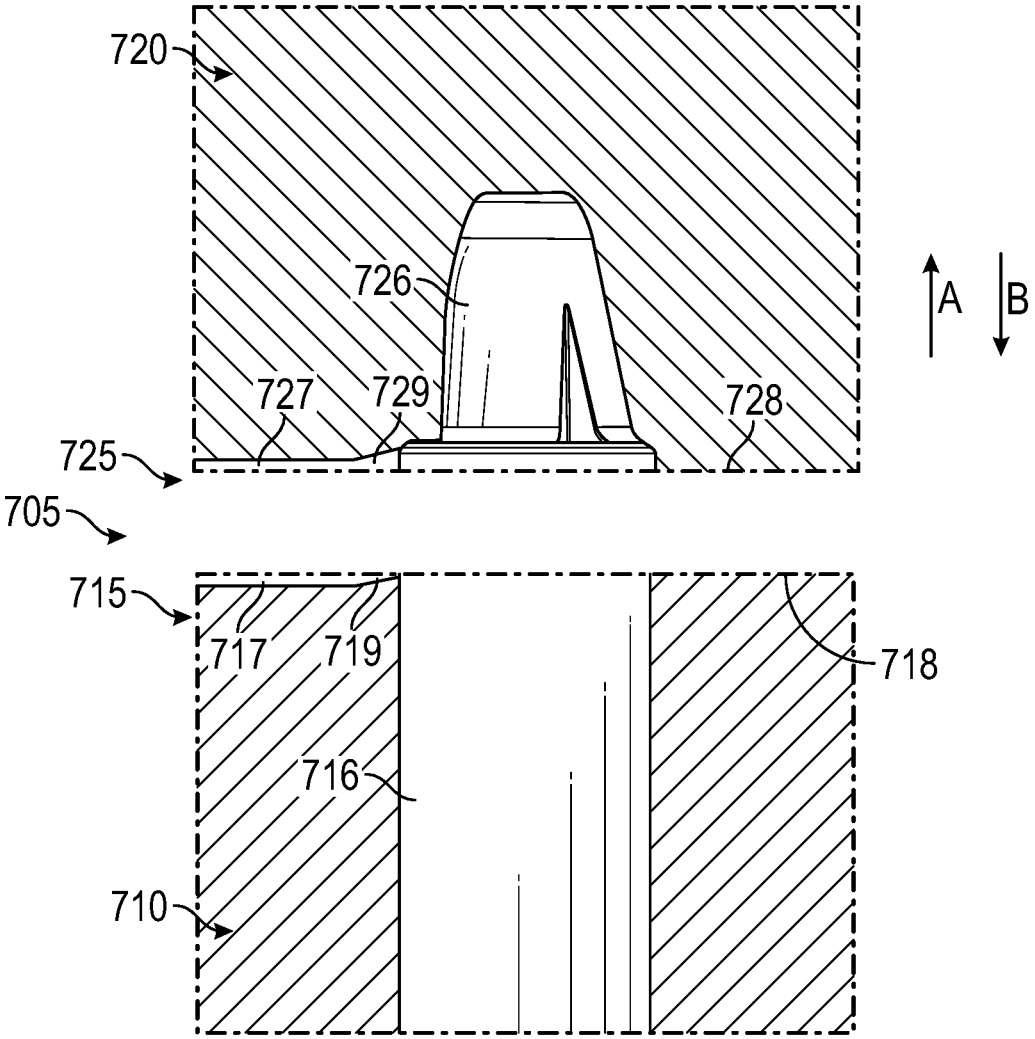
FIG. 30 is a cross-sectional side view illustrating a runner of the tool apparatus of FIG. 22 collectively formed by the upper component and the lower component.

Referring to FIGS. 22-31, a tool assembly 700 for manufacturing a traction element 100/200/300 and associated method of manufacture 800 using the tool assembly 700 are illustrated. FIGS. 22-31 show a cross sectional view of the tool assembly 700. The tool assembly 700 includes an upper component 720 that defines a casting cavity 726 and is configured for coupling and decoupling with a lower assembly 702. The lower assembly 702 defines a lower component 710 that includes a holding steel component 750 configured to hold the metal insert 104/204/304 with the distal cap 130/230/330 of the metal insert 104/204/304 facing the upper component 720. The lower assembly 702 further includes a core steel component 740 that provides a "core" for coring out the interior cavity 120/220/320 of the stud body 102/202/302 of the traction element 100/200/300. With this arrangement, the metal insert 102/202/302 is positioned within the casting cavity 726 as the stud body 102/202/302 is cast around the metal insert 102/202/302 and the core steel component 740. Referring to FIG. 30, the casting material is injected into the casting cavity 726 through a runner 705 collectively defined by an upper runner 725 of the upper component 720 and a lower runner 715 of the lower component 710. The casted stud body 102/202/302 is subsequently allowed to cool within the casting cavity 726 until the stud body 102/202/302 forms a shell. Due to the cored-out interior cavity 120/220/320, the stud body 102/202/302 cools much faster than a stud body without the cored-out interior cavity 120/220/320. In one embodiment, the stud body 102/202/302 was found to use about 35% less casting material and was found to yield a similar improvement in cycling time. The lower assembly 702 further includes an ejector sleeve component 730 that contacts and ejects a cooled traction element 100/200/300 having been formed within the interior cavity 120/220/320. Referring back to FIG. 22, the ejector sleeve component 730, core steel component 740 and holding steel component 750 are concentrically arranged within the lower component 710 of the lower assembly 702 that contacts the upper component 720, as shown.

In some embodiments, the moving components of the tool assembly 700 include but are not limited to the upper component 720, the lower assembly 710 and the ejector sleeve component 730. These moving components are controlled by a controller device 704 in electrical communication with one or more actuators 706 that enable linear motion in the first axial direction A and the opposite second axial direction B. In other embodiments, the moving components of the tool assembly 700 can be manually actuated in the first axial direction A and the opposite second axial direction B. In some embodiments, the tool assembly 700 can be one of an array having a plurality of tool assemblies 700 (not shown) for rapid manufacture of a plurality of traction elements 100/200/300.

Figure 22:
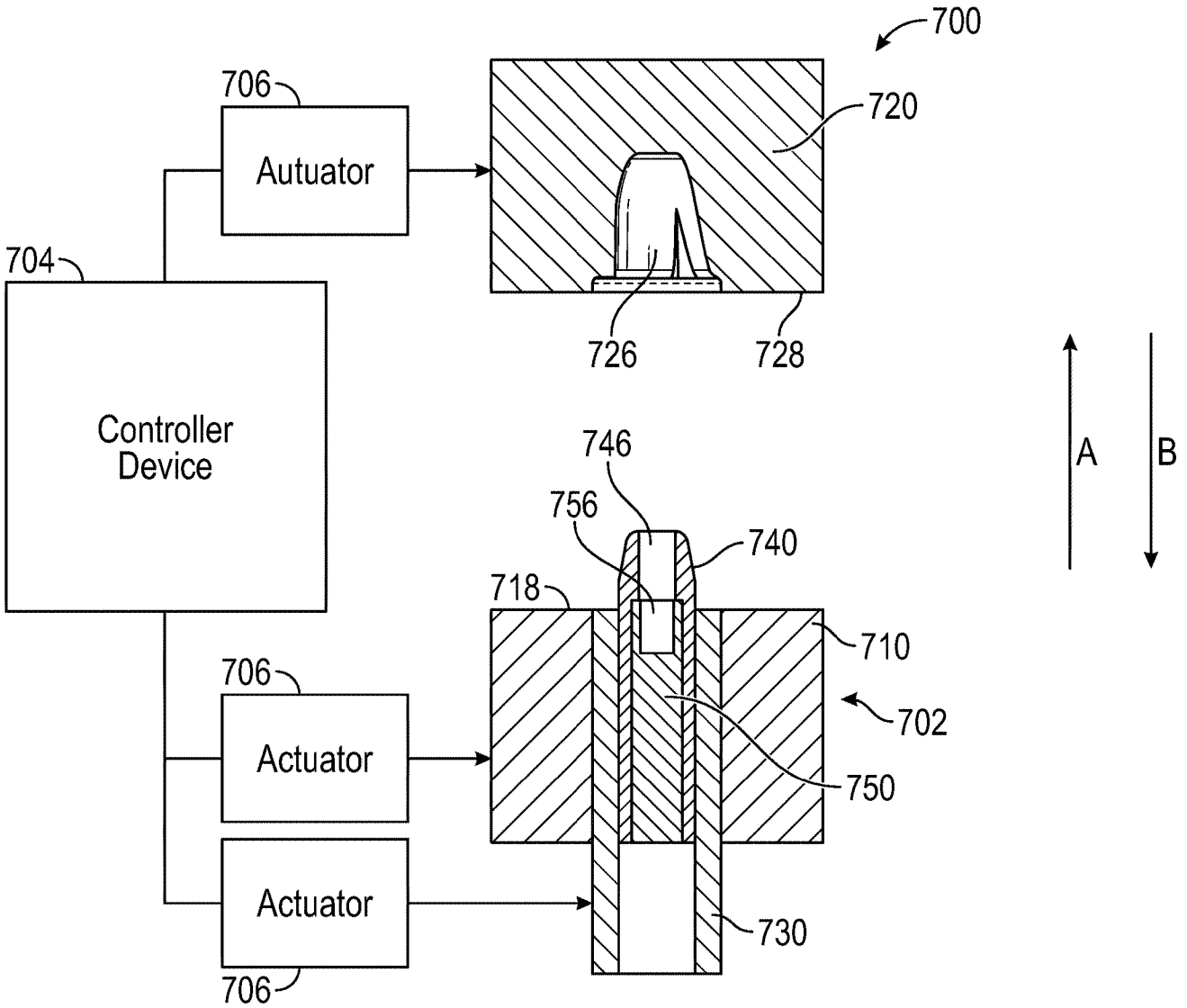
FIG. 22 is a cross-sectional view showing a tool apparatus for manufacture of the traction element of FIG. 1.
Figure 25A:
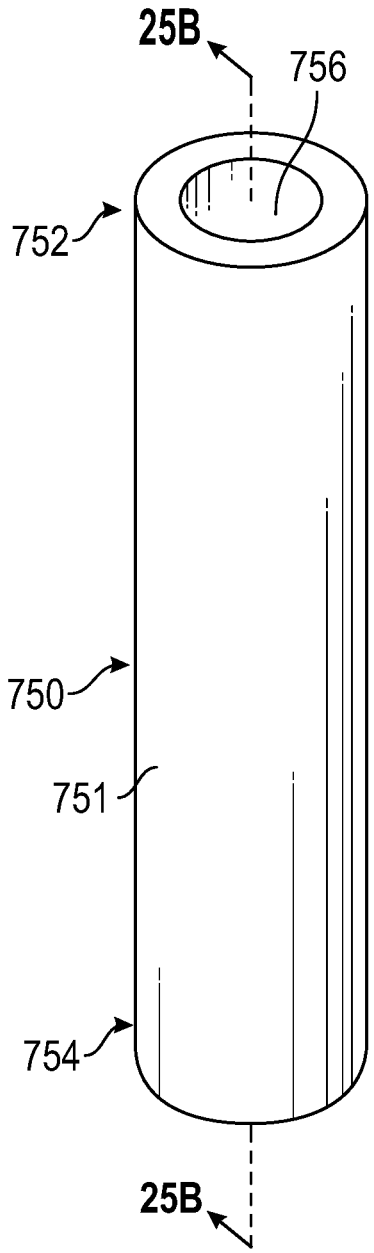
FIGS. 25A and 25B are respective isometric and cross-sectional isometric views showing a holding steel component of the tool apparatus of FIG. 22.
Figure 25B:
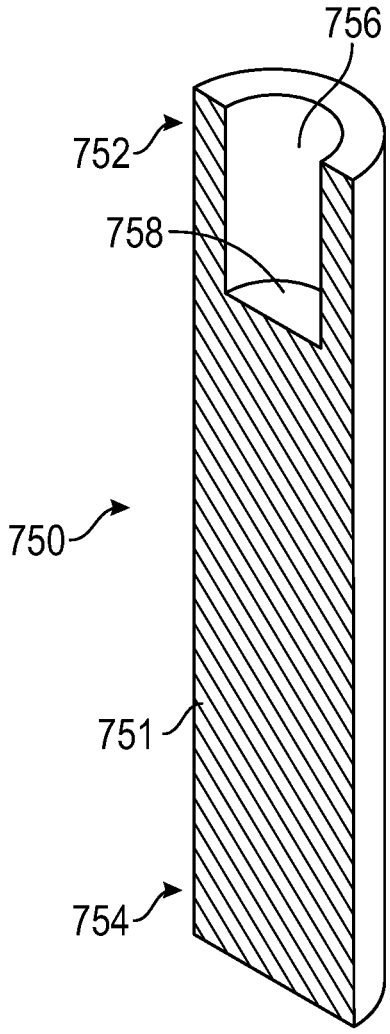

FIGS. 25A and 25B illustrate the holding steel component 750 defining a generally cylindrical body 751 having a distal portion 752 and a proximal portion 754. The distal portion 752 defines a holding cavity 756 for receipt of the metal insert 104/204/304 and an abutment 758 defining an end of the holding cavity 756 for supporting the metal insert 104/204/304 within the holding steel component 750. As shown in FIG. 22, the holding steel component 750 is configured for insertion within the core steel component 740 within the lower assembly 702. The holding steel component 750 receives and secures the proximal threaded portion 132/232/332 of the metal insert 104/204/304 within the holding cavity 756 to orient the distal cap 130/230/330 of the metal insert 104/204/304 towards the upper component 720. In some embodiments, the holding cavity 756 of the holding steel component 750 can be of varying diameter or length to accommodate differences in metal insert diameter and length.

Figure 26A:
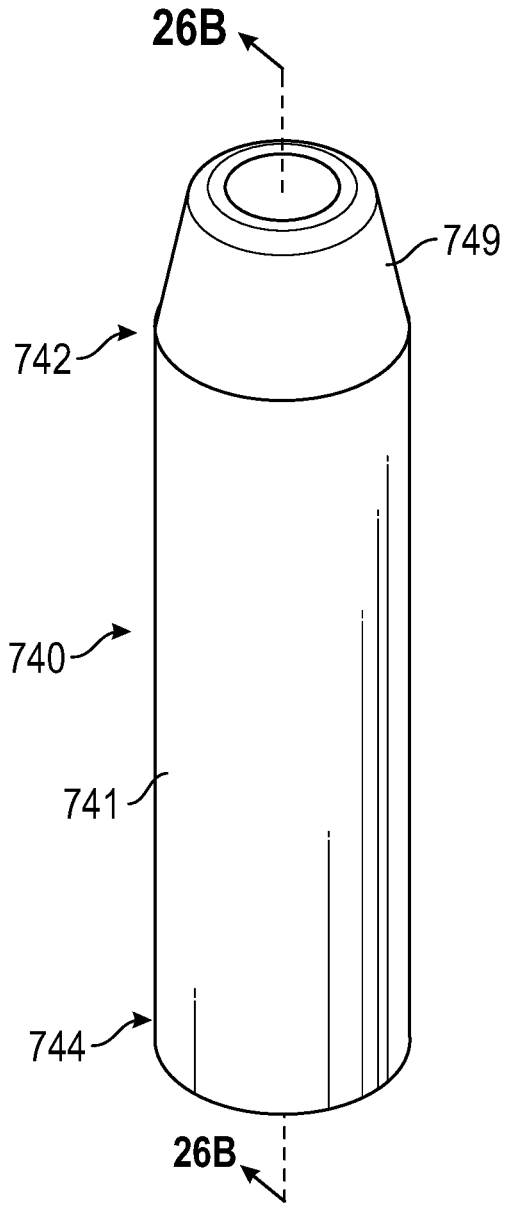
FIGS. 26A and 26B are respective isometric and cross-sectional isometric views showing a core steel component of the tool apparatus of FIG. 22.
Figure 26B:
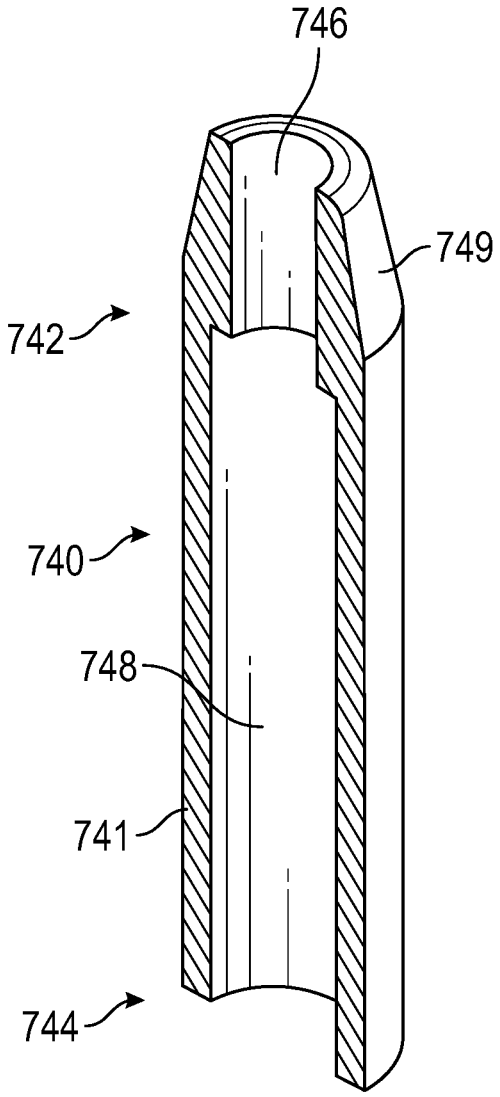

FIGS. 26A and 26B illustrate the core steel component 740 defining a generally cylindrical body 741 having a distal portion 742 and an opposite proximal portion 744. In particular, the core steel component 740 is configured to envelop the holding steel component 750 in a coaxial alignment and provide a core for coring out the interior cavity 120/220/320 of the traction element 100/200/300. The distal portion 742 of the coring steel component 740 defines a tapered coring surface 749 that terminates in an open tip 746. The tapered coring surface 749 provides a mold for coring the interior cavity 120/220/320 of the stud body 102/202/302 during casting of the stud body 102/202/302. The interior of the core steel component 740 includes a core steel channel 748 that communicates with the open tip 746 and is configured to receive the holding steel component 750. While assembled, the core steel channel 748 of the core steel component 740 envelops the distal portion 752 of the holding steel component 750 and the open tip 746 aligns with the holding cavity 756 of the holding steel component 750. As shown in FIG. 22, the open tip 746 has same diameter as the holding cavity 756, and as further illustrated in FIG. 23B, the metal insert 104/204/304 is secured within both the open tip 746 and the holding cavity 756. In some embodiments, the tapered coring surface 749 can be of varying shape, width, roundness, and length to accommodate differences in the stud body 102/202/302. Further, in some embodiments the open tip 746 of the core steel component 740 can be of varying diameter or length to accommodate differences in metal insert diameter and length.

Figure 27A:
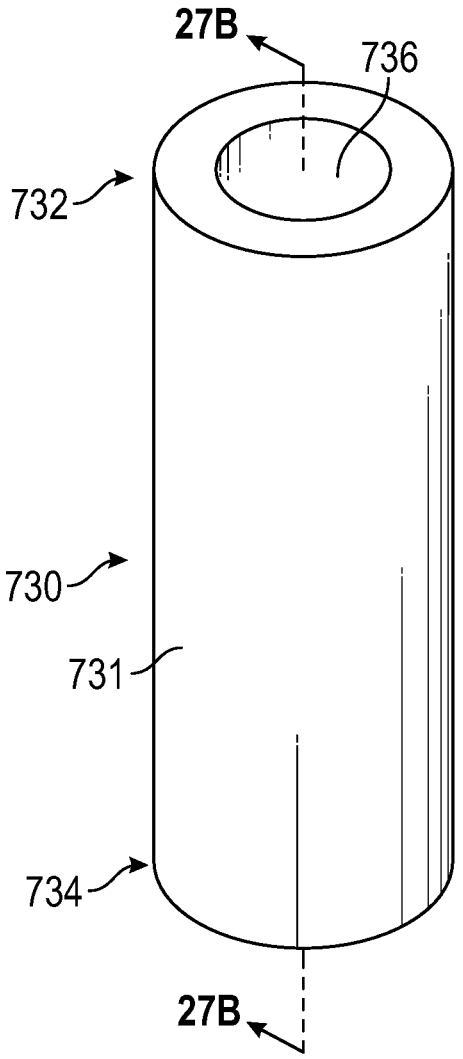
FIGS. 27A and 27B are respective isometric and cross-sectional isometric views showing an ejector sleeve component of the tool apparatus of FIG. 22.
Figure 27B:
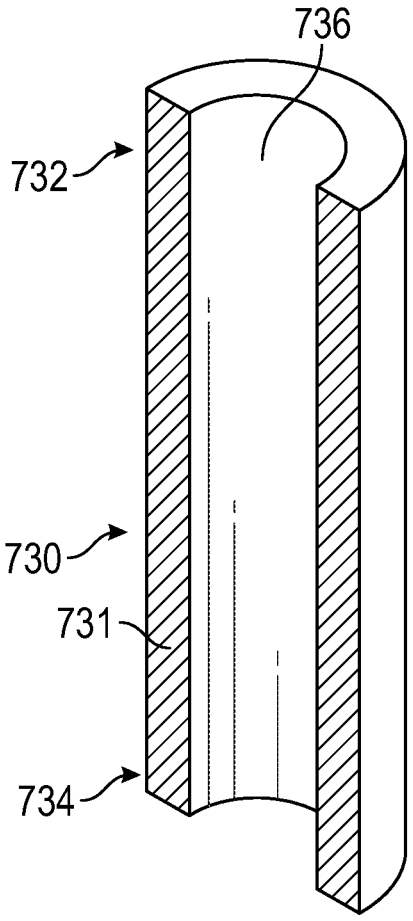

FIGS. 27A and 27B illustrate the ejector sleeve component 730 of the tool assembly 700 defining a tubular body 731 having a distal portion 732 and a proximal portion 734 and further defining an open channel 736 along the direction of elongation of the ejector sleeve component 730. The ejector sleeve component 730 is configured to eject a casted traction element 100/200/300 formed by the tool assembly 700. The ejector sleeve component 730 is located within the lower assembly 702 external to the core steel component 740 such that the core steel component 740 is in coaxial alignment with the ejector sleeve component 730. In particular, the core steel component 740 (and the holding steel component 750 within the core steel component 740) is positioned within the channel 736 of the ejector sleeve component 730. The ejector sleeve component 730 is positioned within and coaxially aligned with a central channel 716 (FIGS. 28A and 28B) of the lower component 710.

Figure 23C:
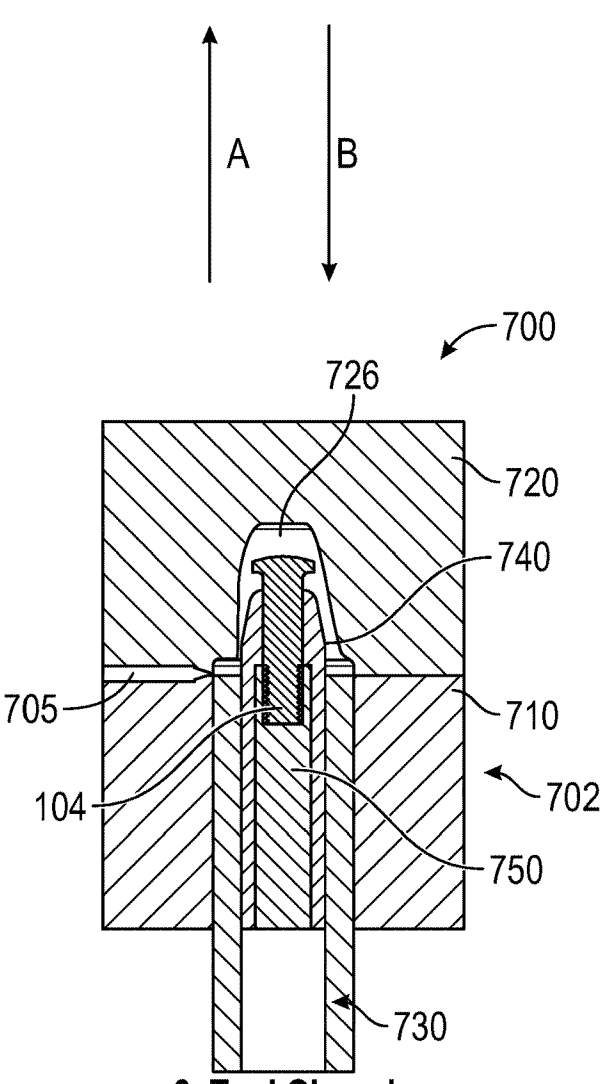
FIGS. 23A-23I are a series of cross-sectional views illustrating a process for manufacture of the traction element using the tool apparatus of FIG. 22.
Figure 23B:
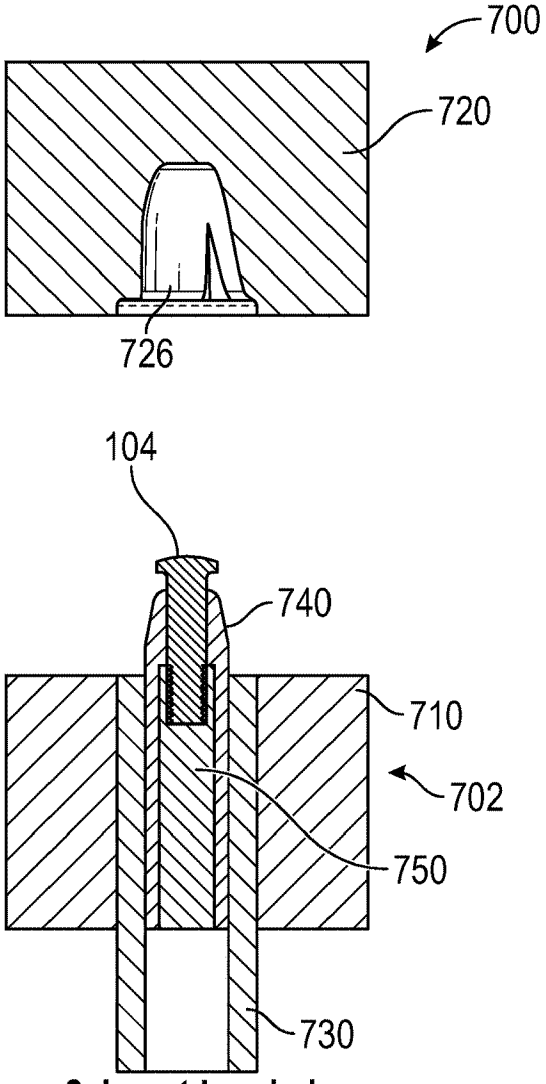
Figure 23A:
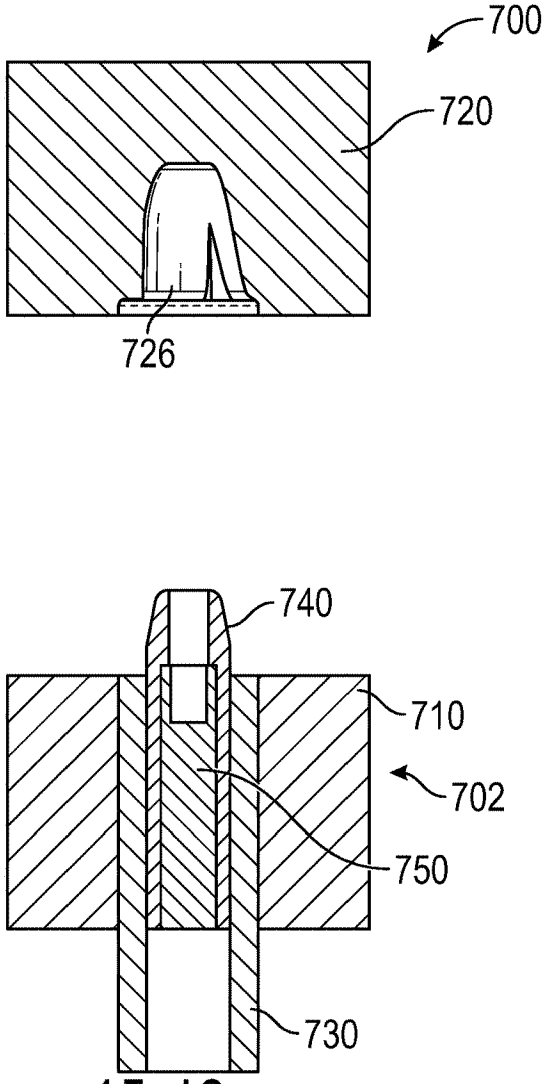
Figure 23F:
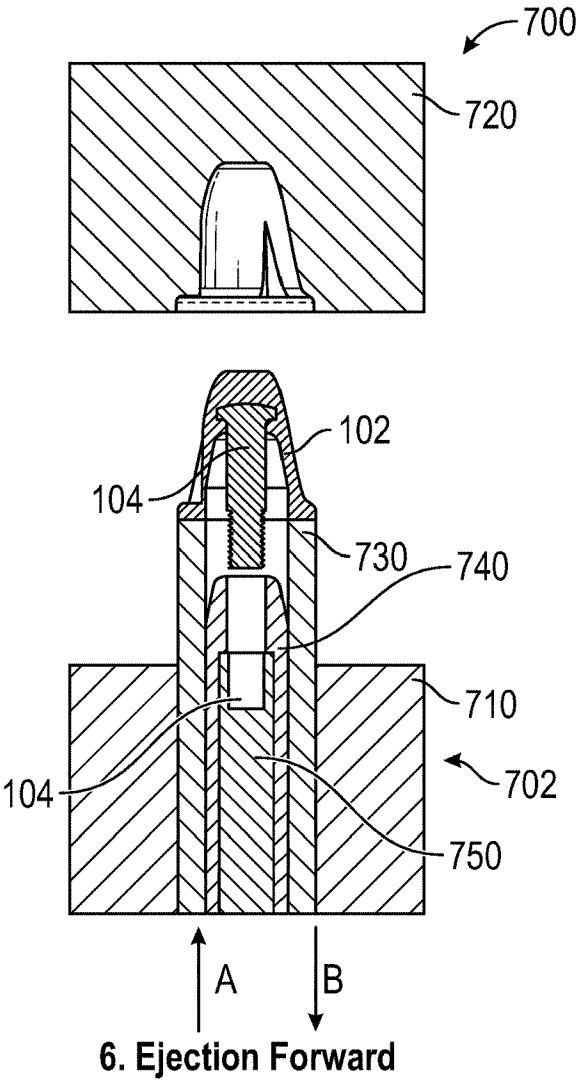
Figure 23E:
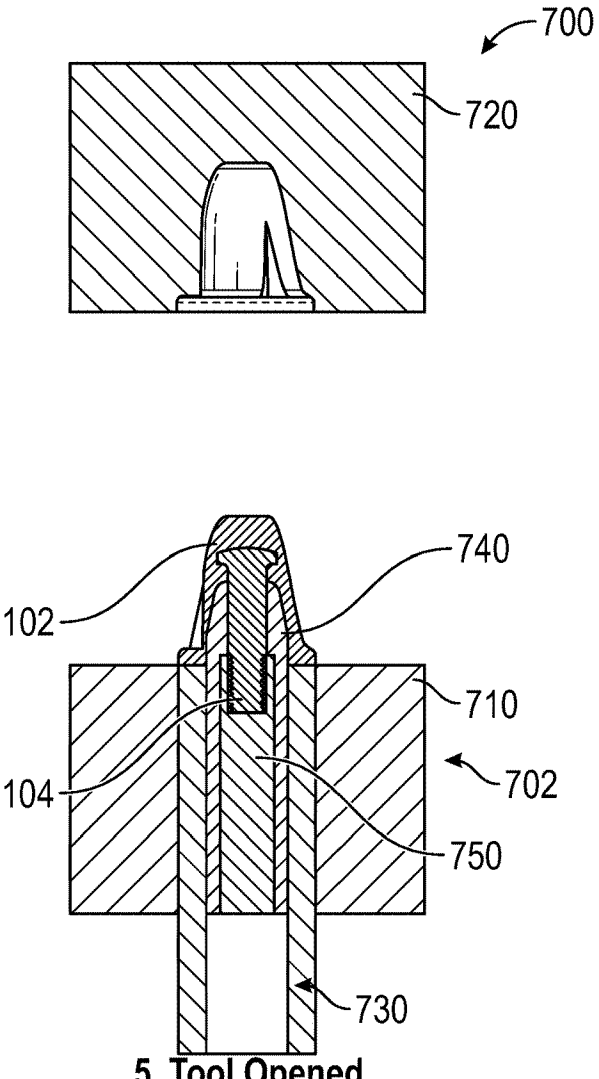
Figure 23D:
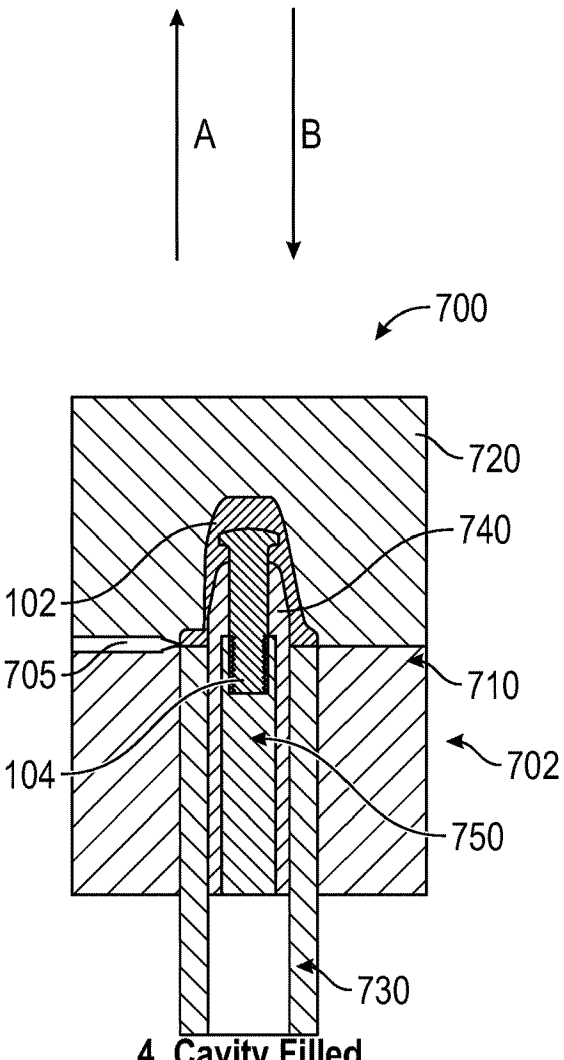
Figure 23I:
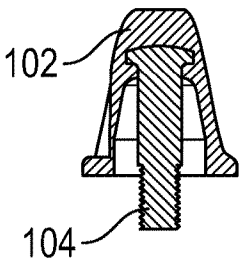
Figure 23H:
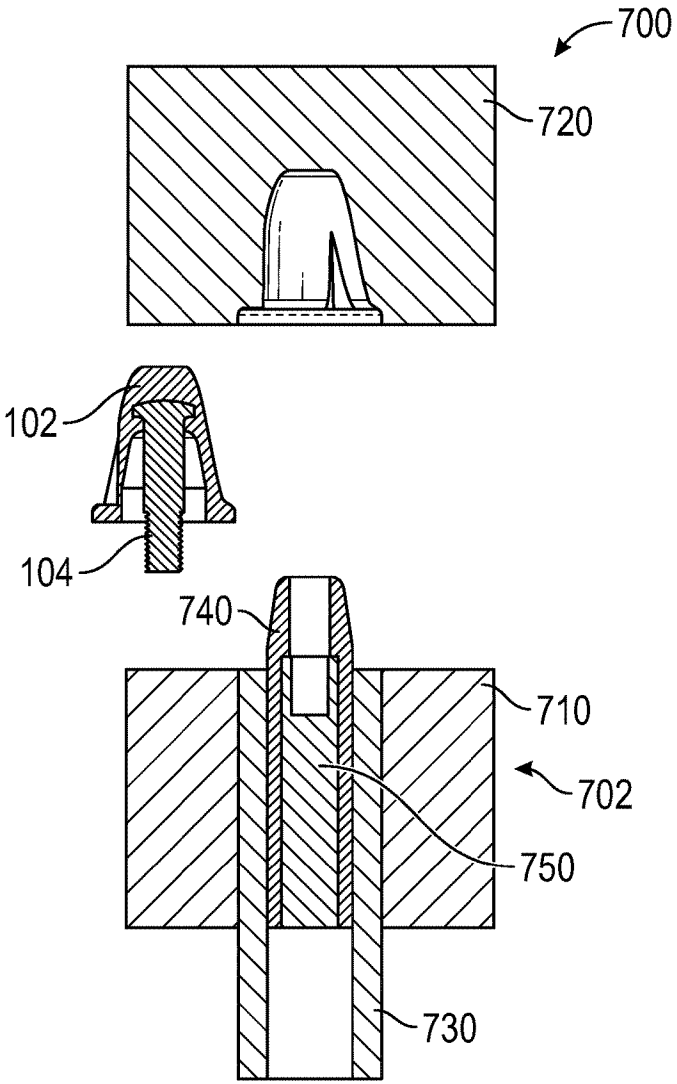
Figure 23G:
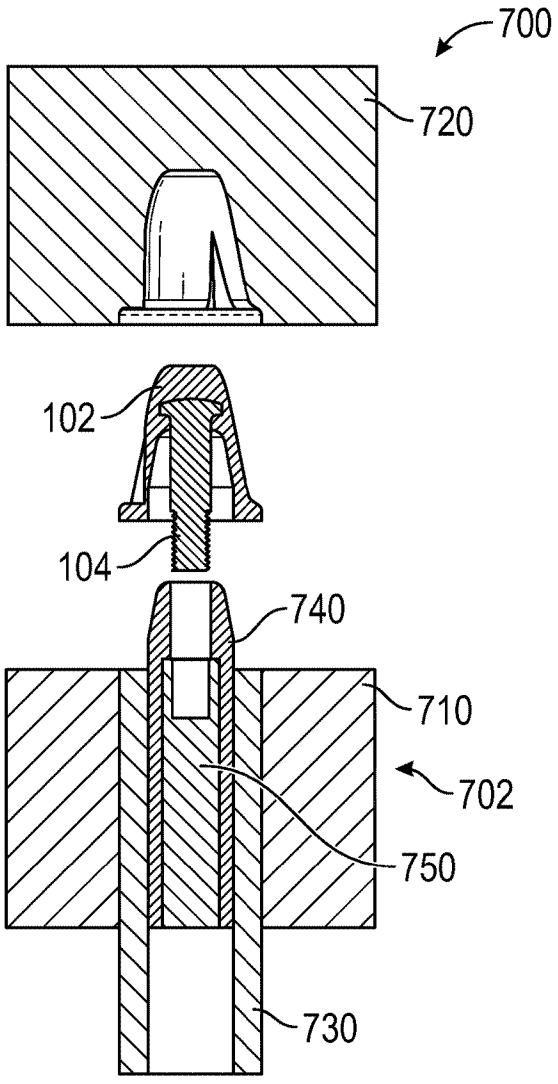
Figure 24C:
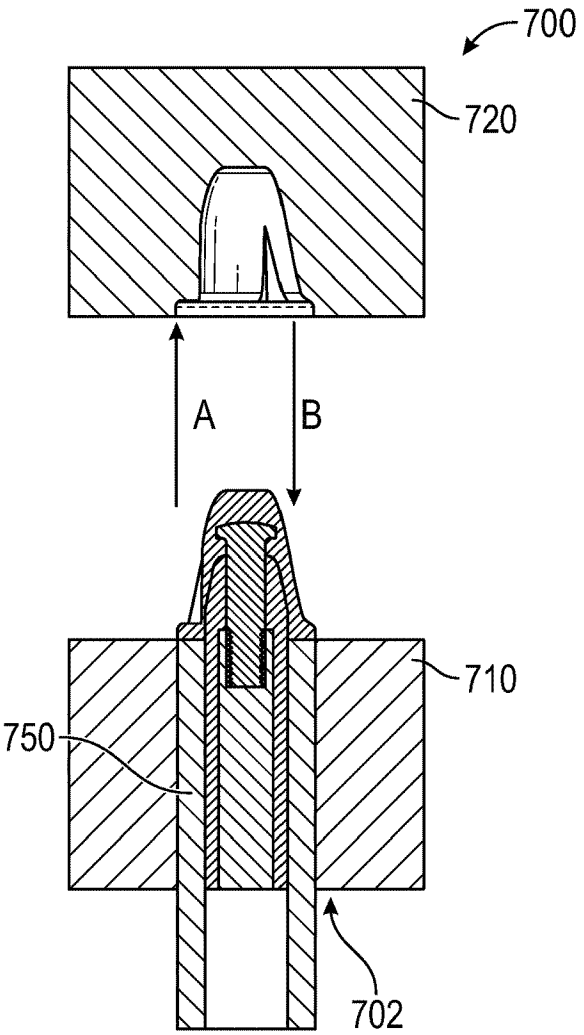
FIGS. 24A-24E are a series of cross-sectional views illustrating an alternate movement configuration during manufacture of the traction element using the tool apparatus of FIG. 22.
Figure 24B:
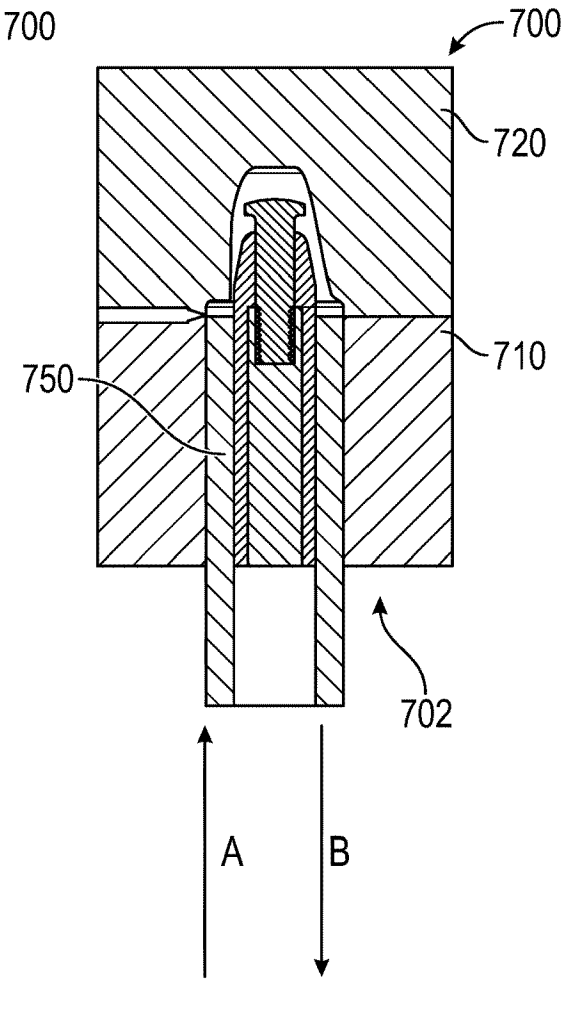
Figure 24A:
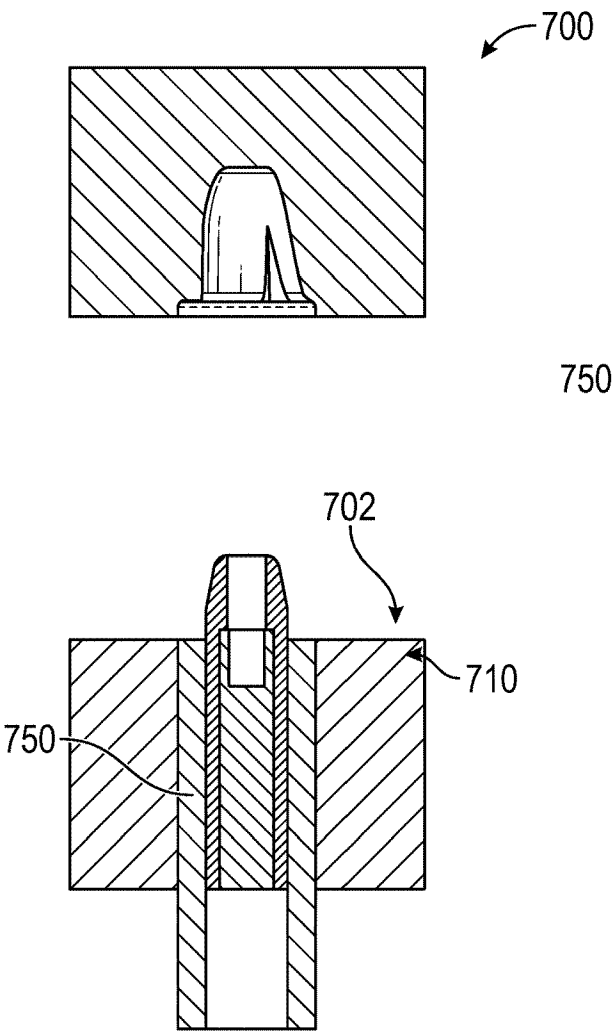
Figure 24E:
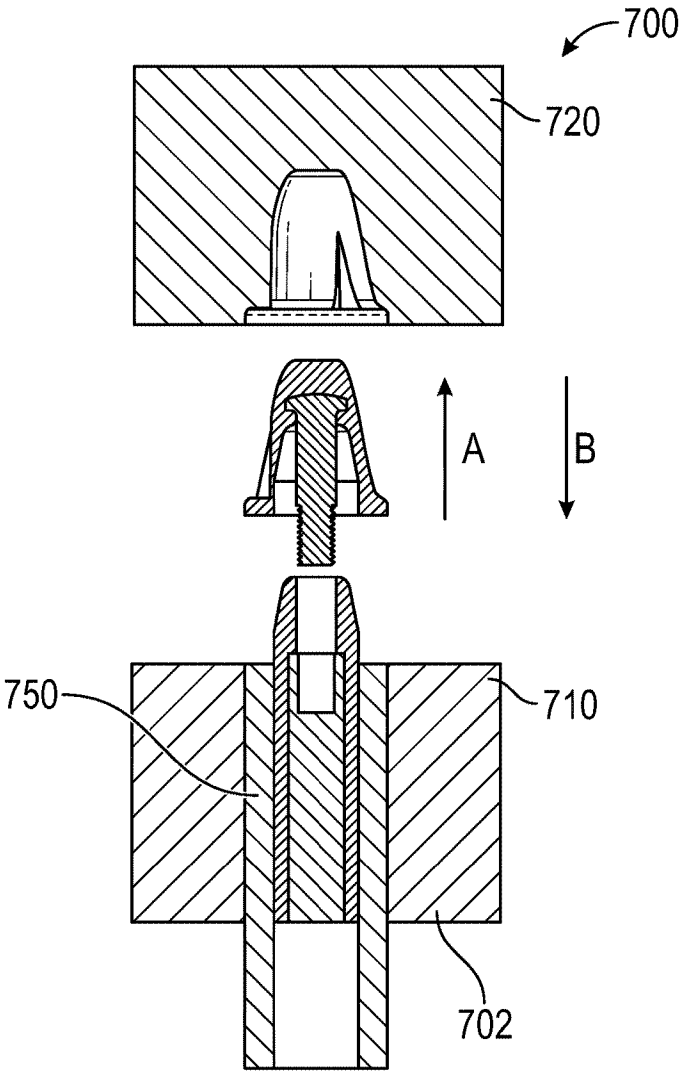
Figure 24D:
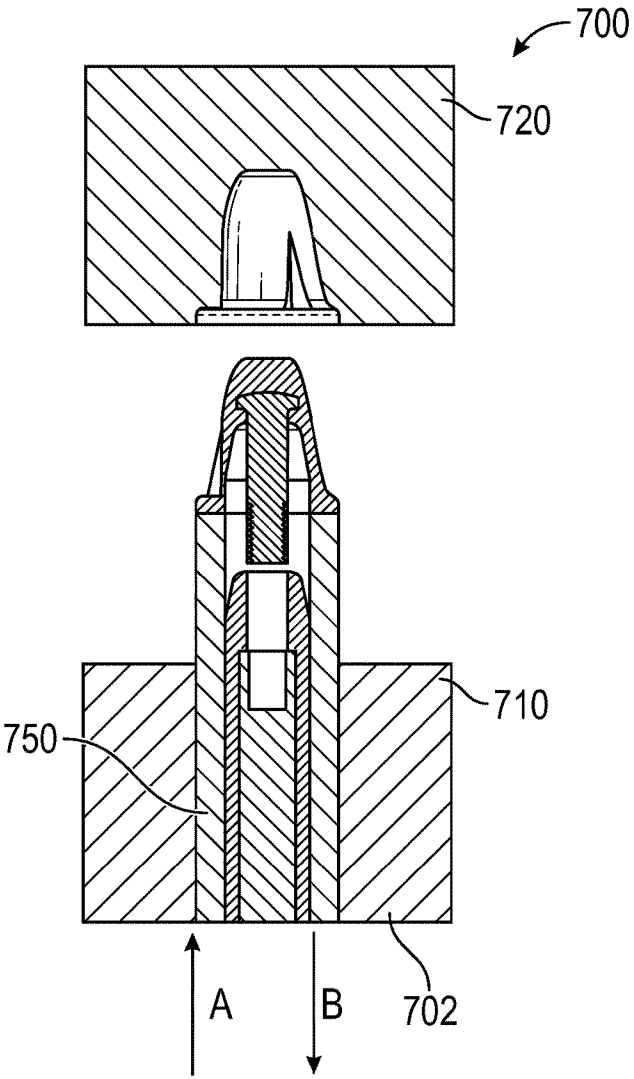

In some embodiments, as shown in FIGS. 23F and 23G, the ejector sleeve component 730 is operable for motion in a first axial direction A and an opposite second axial direction B. As shown in FIG. 23F, the ejector sleeve component 730 is operable to slide in the first axial direction A following casting of the traction element 100/200/300 and push the traction element 100/200/300 away from the core steel component 730 until the metal insert 104/204/304 is fully dislodged from the open tip 746 and the holding cavity 756 (FIG. 22). As shown in FIG. 23G, the ejector sleeve component 730 is operable to slide back into the lower component 710 of the lower assembly in the second axial direction B following ejection of the traction element 100/200/300.

Figure 28A:
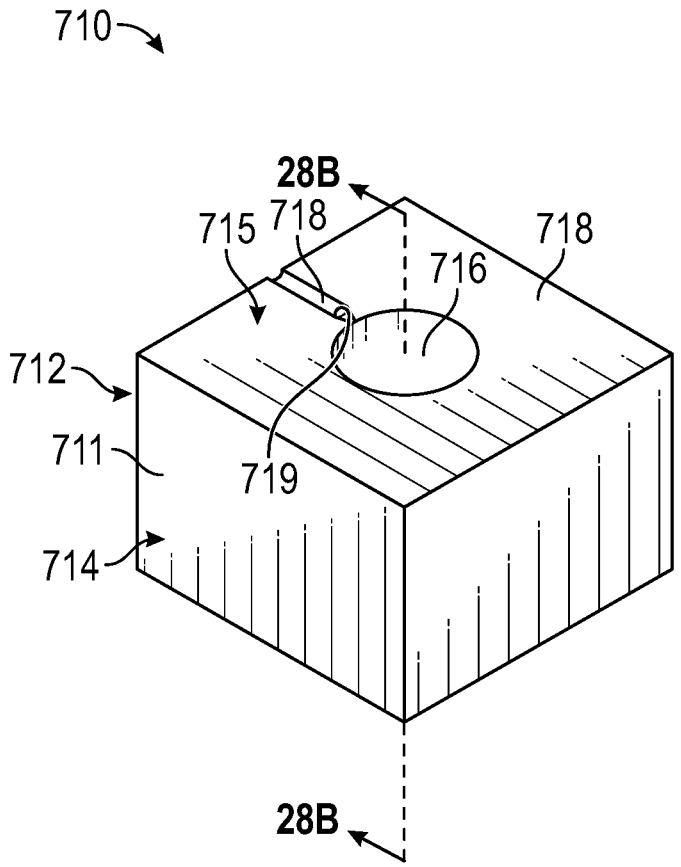
FIGS. 28A and 28B are respective isometric and cross-sectional isometric views showing a lower tool component of the tool apparatus of FIG. 22.
Figure 28B:
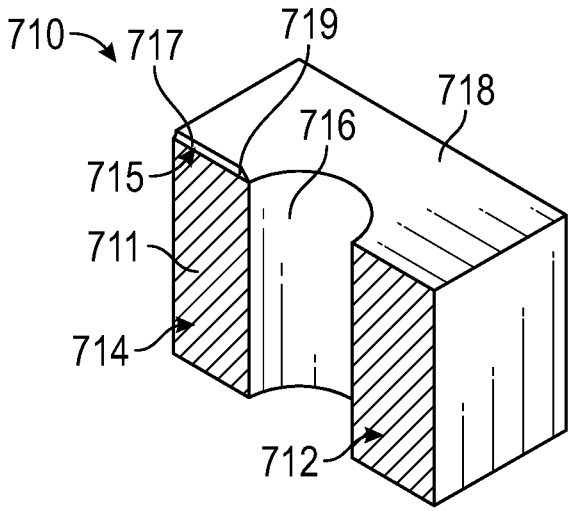

Referring to FIGS. 22, 28A and 28B, the lower component 710 is illustrated defining a generally block-shaped body 711 that includes the central channel 716 for receipt of the ejector sleeve component 730, the core steel component 740, and the holding steel component 750. The ejector sleeve component 730, the core steel component 740, and the holding steel component 750 are all in coaxial alignment with the central channel 716. The lower component 710 includes a distal portion 712 defining a distal surface 718 that contacts a proximal surface 728 of the upper component 720. The distal surface 718 further defines the lower runner 715 on the distal surface 718 that provides a conduit for introducing the casting material into the casting cavity 726 of the upper component 720. In some embodiments, the lower runner 715 includes a runner channel 717 that terminates in a gate 719 that feeds casting material into the casting cavity 726 of the upper component 720. During casting, the casting material is fed into the casting cavity 726 until sufficient pressure is achieved within the casting cavity to ensure the casting material is sufficiently packed.

Referring to FIGS. 29A and 29B, the upper component 720 is illustrated defining a generally block-shaped body 721 defining a proximal portion 724 and an opposite distal portion 722. The upper component 720 includes a proximal surface 728 associated with the proximal portion 724 and the casting cavity 726 that defines a mold for the stud body 102/202/302 of the traction element 100/200/300. The casting cavity 726 includes features on a surface of the casting cavity 726 that define various features of the stud body 102/202/302 including the plurality of cutaways 114 on the outer surface of the stud body 102/202/302. As shown, the casting cavity 726 can include cutaway protrusions that form cutaways 114 on the stud body 102/202/302 when the stud body 102/202/302 is cast within the casting cavity 726. The casting cavity 726 can further include a flange slot 733 for forming the peripheral flange 122/222/322 of the stud body 102/202/302. The upper component 720 can further include the upper runner 725 along the proximal surface 728 that aligns with the lower runner 715 to provide a conduit for introducing the casting material into the casting cavity 726. In some embodiments, the upper runner 725 includes a runner channel 727 that terminates in a gate 729 that feeds casting material into the casting cavity 726 of the upper component 720. The upper runner 725 and the lower runner 715 of the lower component 710 collectively define the runner 705 (FIG. 30) which in some embodiments is ⅜" in diameter when assembled.

The upper component 720 is operable for motion in the first axial direction A and the opposite second axial direction B. In particular, as shown in FIGS. 23B and 23C, the upper component 720 is operable for motion in the second axial direction B following insertion of the metal insert 104/204/304 until the proximal surface 728 (FIG. 22) of the upper component 720 engages the distal surface 718 (FIG. 22). of the lower component 710 such that the molding cavity 726 is positioned around the coring steel component 740 of the lower assembly 702 and the metal insert 104/204/304 to assume a closed position of the tool assembly. As further shown in FIGS. 23D and 23E, following casting and cooling of the stud body 102/202/302, the upper component 720 is operable for motion in the first axial direction A to assume an open position of the tool assembly 700 and enable ejection of the traction element 100/200/300.

It should be noted that in some embodiments, as described above, the tool assembly 700 can be opened or closed by actuating the upper component 720 in the first direction A or the opposite second direction B relative to the lower assembly 710, while the lower assembly 710 remains stationary. In other embodiments, such as the embodiment of FIGS. 24A-24E, the tool assembly 700 can be opened or closed by actuating the lower assembly 702 in the second direction B or the first direction A relative to the upper component 720, while the upper component 720 remains stationary. In a further embodiment, the tool assembly 700 can be opened or closed by actuating the upper component 720 in the first direction A or the opposite second direction B relative to the lower assembly 710, while the lower assembly 710 is actuated in the second direction B or the first direction A relative to the upper component 720 to engage the upper component 720 in the middle.

In some embodiments, each component of the tool assembly 700 including the holding steel component 750, the core steel component 740, the ejector sleeve component 730, the lower component 710 and the upper component 720 are manufactured from an assortment of tool steel. In one embodiment, components that couple to form a tight seal, such as the lower component 710 and the upper component 720, can be made of S7 or another type of suitable tool steel. The ejector sleeve component 730 slides between the lower component 710 and the core steel component 740, which remain fixed relative to one another. Thus, it is contemplated that the ejector sleeve component 730 can be manufactured of harder steel than the lower component 710 and the core steel component 740 such as A2 or D2 steel. The core steel component 740 and holding steel component 750 remain stationary relative to one another, and do not contact the lower component 710 or upper component 720 directly; thus the core steel component 740 and holding steel component 750 can also be made of S7 or another type of suitable tool steel that is softer than that of the ejector sleeve component 740.

FIGS. 23A-23I illustrate one method of manufacture 800 (FIG. 31) of the traction element 100/200/300. In FIG. 23A, the tool assembly 700 assumes an open position with the upper component 720 being oriented above the lower assembly 702 with the casting cavity 726 oriented towards the lower assembly 702 and the upper component 720 and lower assembly 702 are separated from one another. In FIG. 23B, the metal insert 104/204/304 of the traction element 100/200/300 is inserted into the holding steel component 740 and the core steel component 730. In FIG. 23C, the tool assembly 700 assumes a closed position such that the upper component 720 and the lower assembly 702 including the lower component 710 contact one another to form the casting cavity 726 around the distal cap 130/230/330 of the metal insert 104/204/304. In FIG. 23D, the casting cavity 726 is filled in by injecting casting material through the runner 705 collectively defined by the upper runner 725 and the lower runner 715 and into the casting cavity 726 (FIG. 30) of the upper component 720. The casting material that forms the stud body 102/202/302 is cast around the distal cap 130/230/330 of the metal insert 104/204/304 such that the metal insert 104/204/304 is permanently coupled to the stud body 102/202/302. The casting material fills the casting cavity 726 around the core steel component 740, thus forming the interior cavity 120/220/320 of the traction element 100/200/300 by coring rather than boring or drilling away at the stud body 102/202/302 to remove casting material. Once the casting cavity 726 is filled with casting material and the casting material in the form of the stud body 102/202/302 has sufficiently cooled enough to form a hardened shell, then as shown in FIG. 23E the tool assembly 700 is opened to expose the traction element 100/200/300 including the stud body 102/202/302 and the metal insert 104/204/304. As shown in FIG. 23F, the ejector sleeve component 730 is actuated in the first axial direction A relative to the lower component 710 such that the proximal threaded portion 132/232/332 of the metal insert 104/204/304 is pushed out of the holding steel component 750 and core steel component 740. As further illustrated in FIG. 23F, the ejector sleeve component 730 is retracted back into the lower component 710 and the traction element 100/200/300 is released as the tool assembly 700 is reset. FIGS. 23H and 23I illustrate collection of the finished traction element 100/200/300 including the stud body 102/202/302, the metal insert 104/204/304 and the interior cavity 120/220/320.

Figure 31:
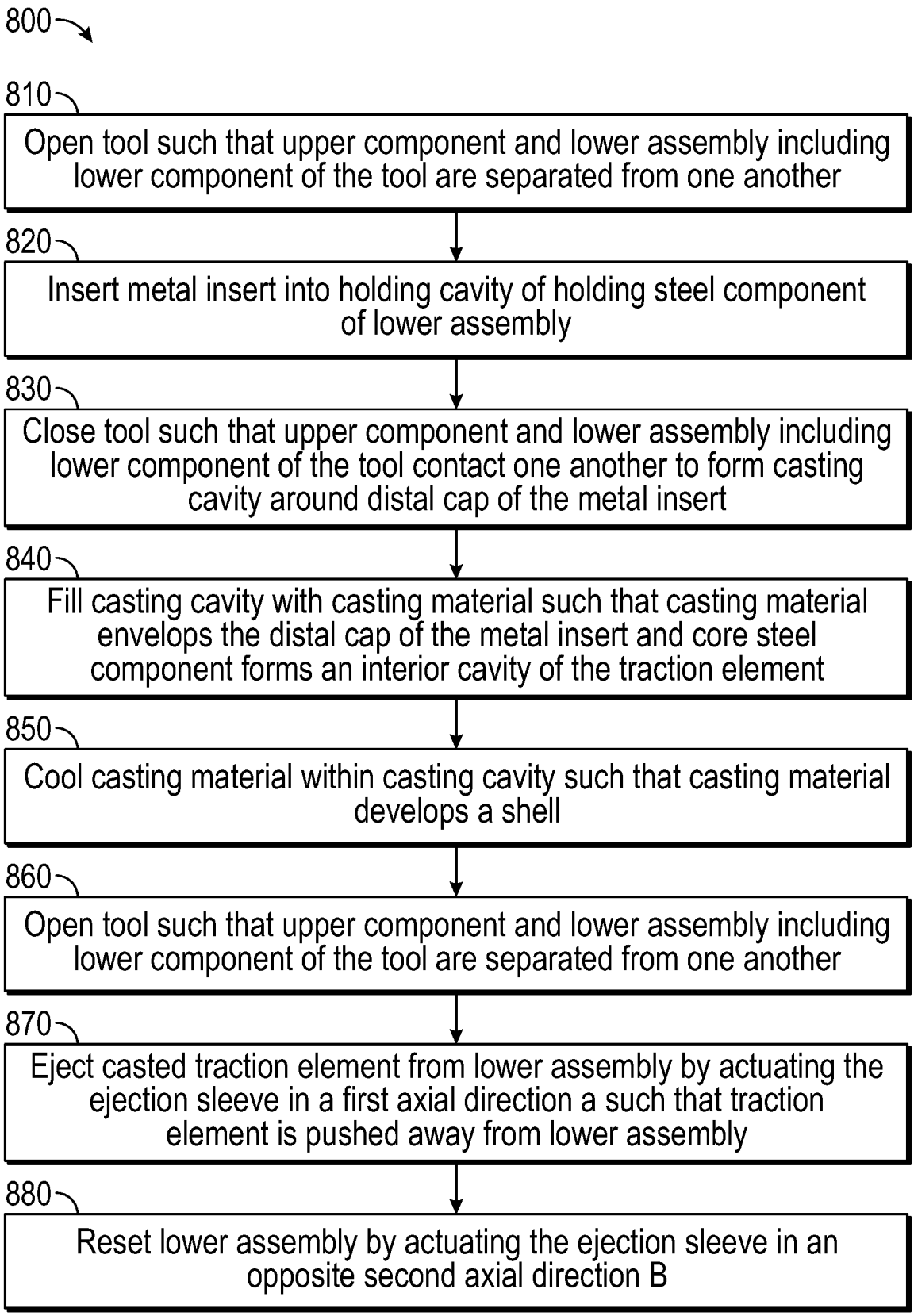
FIG. 31 is a flowchart showing a method of manufacture of a traction element using the tool apparatus of FIG. 22.

FIG. 31 illustrates a process flow for the method of manufacture 800 of a traction element 100/200/300 using the tool assembly 700 using the aforementioned coring process. At block 810 corresponding with FIG. 23A, the tool assembly 700 assumes an open position such that the upper component 720 and the lower assembly 702 including the lower component 710 are separated from one another. At block 820 corresponding with FIG. 23B, the proximal threaded portion 132/232/332 of the metal insert 104/204/304 is inserted into the holding cavity 756 of the holding steel component 750 of the lower assembly 710. At block 830 corresponding with FIG. 23C, the tool assembly 700 assumes a closed position such that the upper component 720 and the lower assembly 702 including the lower component 710 of the tool assembly 700 contact one another to form the casting cavity 726 around the distal cap 130/230/330 of the metal insert 104/204/304. At block 840 corresponding with FIG. 23D, the casting cavity 726 is filled with casting material to form the stud body 102/202/302. The casting material envelops the distal cap 130/230/330 of the metal insert 104/204/304 and the core steel component 740, forming the interior cavity 120/220/320 of the stud body 102/202/302. At block 850, the casted material forming the stud body 102/202/302 is allowed to cool within the casting cavity 726 until the casting material develops a shell. At block 860 corresponding with FIG. 23E, the tool assembly 700 is opened such that the upper component 720 and the lower assembly 702 including the lower component 710 are separated from one another. At block 870 corresponding with FIG. 23F, the casted traction element 100/200/300 is ejected from the lower assembly 710 by actuating the ejector sleeve component 730 in a first axial direction A relative to the lower component 710 such that the traction element 100/200/300 is pushed away from the lower assembly 702. The traction element 100/200/300 can then be collected. At block 880, the lower assembly 702 of the tool assembly 700 is reset by actuating the ejector sleeve component 730 in the opposite second axial direction B relative to the lower component 710.

It should be understood from the foregoing that, while particular embodiments have been illustrated and described, various modifications can be made thereto without departing from the spirit and scope of the invention as will be apparent to those skilled in the art. Such changes and modifications are within the scope and teachings of this invention as defined in the claims appended hereto.

What is claimed is:

1. A method, comprising:

providing a metal insert including a shaft portion formed between a distal cap and a proximal threaded portion;

providing a tool assembly for manufacture of a traction element, the tool assembly defining:

an upper component including a proximal surface that defines a casting cavity, wherein the casting cavity defines a mold for a stud body of the traction element;

a lower assembly positioned proximal to the upper component, the lower assembly including:

a lower component, the lower component including a distal surface and a central channel along a direction of elongation, wherein the distal surface is oriented towards the proximal surface of the upper component;

a core steel component including a distal portion defining a tapered coring surface that terminates in an open tip and further defining a core steel channel along the direction of elongation that communicates with the open tip, wherein the core steel component is positioned within the central channel of the lower component; and a holding steel component positioned in coaxial alignment within the core steel channel and defining a holding cavity for receipt of the proximal threaded portion of the metal insert;

wherein the tool assembly is operable to close by actuating the upper component or the lower assembly in a first or second axial direction such that the distal surface of the lower component and the proximal surface of the upper component contact one another; and inserting the proximal threaded portion of the metal insert into the holding cavity of the holding steel component and the open tip of the core steel component such that the distal cap of the metal insert faces the casting cavity of the upper component;

closing the tool assembly such that the proximal surface of the upper component contacts the distal surface of the lower component and the casting cavity envelops the distal cap of the metal insert; and injecting a casting material into the casting cavity to form the stud body from the casting material around the distal cap of the metal insert such that the metal insert is permanently coupled to the stud body, wherein the casting material is formed around the tapered coring surface of the core steel component such that an interior cavity is formed within the stud body around the metal insert.

2. The method of claim 1, further comprising:

allowing the stud body to cool within the casting cavity.

3. The method of claim 1, further comprising:

opening the tool assembly by actuating the upper component or the lower assembly in the first or second axial direction such that the upper component and the lower assembly are separated from one another.

4. The method of claim 1, wherein the casting cavity includes a cutaway protrusion to form a cutaway on an outer surface of the stud body.

5. The method of claim 1, wherein the lower component further includes a lower runner defined along the distal surface of the lower component and wherein the upper component further includes an upper runner defined along the proximal surface of the upper component such that when the tool assembly is closed, the lower runner and upper runner collectively form a runner, wherein the runner is in fluid flow communication with the casting cavity and wherein casting material is fed into the casting cavity through the runner.

6. The method of claim 1, wherein the lower assembly further includes an ejector sleeve component defining an open channel, wherein the core steel component and holding steel component are positioned in coaxial alignment within the open channel, and wherein the ejector sleeve component is configured to contact and eject a formed traction element from the lower assembly.

7. The method of claim 6, further comprising:

ejecting the traction element by actuating the ejection sleeve in the first axial direction such that the ejection sleeve contacts the stud body and pushes the stud body in the first axial direction until the proximal threaded portion of the metal insert of the traction element is removed from the holding cavity of the holding steel component.

8. A system, comprising:

a tool assembly for manufacture of a traction element defining:

an upper component including a proximal surface that defines a casting cavity, wherein the casting cavity defines a mold for a stud body of the traction element;

a lower assembly positioned proximal to the upper component, the lower assembly including:

a lower component, the lower component including a distal surface and a central channel along a direction of elongation, wherein the distal surface is oriented towards the proximal surface of the upper component;

a core steel component including a distal portion defining a tapered coring surface that terminates in an open tip and further defining a core steel channel along the direction of elongation that communicates with the open tip, wherein the core steel component is positioned within the central channel of the lower component; and a holding steel component positioned in coaxial alignment within the core steel channel and defining a holding cavity for receipt of a proximal threaded portion of a metal insert;

wherein the tool assembly is operable to close by actuating the upper component or the lower assembly in a first or second axial direction such that the distal surface of the lower component and the proximal surface of the upper component contact one another.

9. The system of claim 8, wherein the tool assembly is operable to:

receive the proximal threaded portion of the metal insert into the holding cavity of the holding steel component and the open tip of the core steel component such that a distal cap of the metal insert faces the casting cavity of the upper component;

assume a closed position such that the proximal surface of the upper component contacts the distal surface of the lower component and the casting cavity envelops the distal cap of the metal insert; and receive a casting material into the casting cavity to form the stud body from the casting material around the distal cap of the metal insert such that the metal insert is permanently coupled to the stud body, wherein the casting material is formed around the tapered coring surface of the core steel component such that an interior cavity is formed within the stud body around the metal insert.

10. The system of claim 8, wherein the stud body is allowed to cool within the casting cavity.

11. The system of claim 8, wherein the tool assembly is configured to: assume an open position by actuating the upper component or the lower assembly in the first or second axial direction such that the upper component and the lower assembly are separated from one another.

12. The system of claim 8, wherein the casting cavity includes a cutaway protrusion to form a cutaway on an outer surface of the stud body.

13. The system of claim 8, wherein the lower component further includes a lower runner defined along the distal surface of the lower component and wherein the upper component further includes an upper runner defined along the proximal surface of the upper component such that when the tool assembly is closed, the lower runner and upper runner collectively form a runner, wherein the runner is in fluid flow communication with the casting cavity and wherein casting material is fed into the casting cavity through the runner.

14. The system of claim 8, wherein the lower assembly further includes an ejector sleeve component defining an open channel, wherein the core steel component and holding steel component are positioned in coaxial alignment within the open channel, and wherein the ejector sleeve component is configured to contact and eject a formed traction element from the lower assembly.

15. The system of claim 14, wherein the tool assembly is further operable to:

eject the traction element by actuating the ejection sleeve in the first axial direction such that the ejection sleeve contacts the stud body and pushes the stud body in the first axial direction until the proximal threaded portion of the metal insert of the traction element is removed from the holding cavity of the holding steel component.

* * * * *